US008011844B2

(12) United States Patent
Yada et al.

(10) Patent No.: US 8,011,844 B2
(45) Date of Patent: Sep. 6, 2011

(54) PRINTER HAVING DETECTING ARM FOR DETECTING NEAR-END STATE OF PAPER ROLL

(75) Inventors: Yuji Yada, Shinagawa (JP); Tetsuhiro Ishikawa, Shinagawa (JP); Masaru Kihara, Shinagawa (JP); Fumio Sakurai, Shinagawa (JP); Yukihiro Mori, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 992 days.

(21) Appl. No.: 11/907,949

(22) Filed: Oct. 18, 2007

(65) Prior Publication Data

US 2008/0095564 A1 Apr. 24, 2008

(30) Foreign Application Priority Data

Oct. 20, 2006 (JP) ..... 2006-285715
Sep. 6, 2007 (JP) ..... 2007-231778

(51) Int. Cl.
*B65H 26/08* (2006.01)
*B41J 15/02* (2006.01)

(52) U.S. Cl. ..... 400/613; 400/693; 242/563; 242/563.2

(58) Field of Classification Search ..... 400/613, 400/693; 242/563, 563.2; *B41J 15/02; B65H 26/08*
See application file for complete search history.

(56) References Cited

U.S. PATENT DOCUMENTS 5,884,861 A * 3/1999 Hosomi et al. ..... 242/563
7,553,098 B2 * 6/2009 Maekawa et al. ..... 400/613

FOREIGN PATENT DOCUMENTS

JP 60223761 A * 11/1985
JP 2004-262059 9/2004

* cited by examiner

*Primary Examiner* — Leslie J Evanisko
(74) *Attorney, Agent, or Firm* — Staas & Halsey LLP

(57) ABSTRACT

A printer is disclosed. The printer includes a main body which contains a paper roll container where a paper roll is loaded, a lid for closing an opening section of the main body through which opening section the paper roll is loaded in the paper roll container, a letter printing mechanism which is formed when the lid is closed, and a detecting arm disposed on a rear surface of the lid for detecting a near-end state of the paper roll. When the paper roll is loaded in the paper roll container and the lid is closed, an arm main body of the detecting arm contacts an outer circumferential surface of the paper roll. When the paper roll reaches the near-end state, the detecting arm does not contact the outer circumferential surface of the paper roll and is moved, and a switch disposed at the main body becomes OFF.

10 Claims, 25 Drawing Sheets

PRINTER HAVING DETECTING ARM FOR DETECTING NEAR-END STATE OF PAPER ROLL

BACKGROUND OF THE INVENTION

1. Field of the Invention

The present invention generally relates to a printer having a paper roll container in which a paper roll where belt-shaped paper is wound plenty of times is loaded and the loaded paper roll in the paper roll container can be easily exchanged for a new paper roll.

2. Description of the Related Art

In a printer using a paper roll, when the remaining amount of paper in the paper roll becomes approximately 1 to 2 meters (this is called the "near-end state"), the near-end state is detected and reported to a user for exchanging the paper roll for a new paper roll. In many cases, as the paper, thermosensitive paper is used when using a thermal printer.

In many cases, a printer using thermosensitive paper includes a so-called "easy loading mechanism". In the "easy loading mechanism", the printer provides a paper roll container for containing a thermosensitive paper roll and a lid for closing an opening section of the paper roll container by being rotated, and when the remaining amount of thermosensitive paper in the thermosensitive paper roll becomes low and a new thermosensitive paper roll is loaded in the thermosensitive paper roll container by exchanging the old one for the new one, the tip of the new thermosensitive paper is pulled out and sandwiched between a thermal head and a platen roller. That is, the thermosensitive paper roll can be easily exchanged by the "easy loading mechanism".

In order to easily exchange the thermosensitive paper roll, the printer having the easy loading mechanism needs to provide a mechanism to detect the near-end state. Hereinafter the mechanism to detect the near-end state is referred to as a near-end detecting mechanism.

The printer is built in, for example, a POS (point of sale) apparatus. Since the POS apparatus is installed in a shop, the size of the POS apparatus is required to be small and the size of the printer itself is also required to be small.

A conventional printer using the easy loading mechanism includes the near-end detecting mechanism on the side surface of the printer main body (refer to Patent Document 1).

[Patent Document 1] Japanese Laid-Open Patent Application No. 2004-262059

Since the near-end detecting mechanism is stuck out from the printer main body, the printer cannot be small sized and the POS apparatus including the printer also cannot be small sized.

SUMMARY OF THE INVENTION

The present invention may provide a printer whose size is small in which an easy loading mechanism having a near-end detecting mechanism is included.

According to one aspect of the present invention, there is provided a printer. The printer includes a main body having a paper roll container for containing a paper roll in which belt-shaped paper is wound plenty of times, a lid rotatably attached to the main body for closing an opening section of the main body through which opening section the paper roll is loaded in the paper roll container, a letter printing mechanism which operates when the lid is closed and prints a letter (image) on the belt-shaped paper of the paper roll by pulling out the belt-shaped paper from the paper roll container, and a detecting arm which detects a near-end state of the paper roll contained in the paper roll container. The detecting arm is rotatably attached onto a rear surface of the lid.

According to an embodiment of the present invention, since a detecting arm for detecting a near-end state of a paper roll loaded in a paper roll container is rotatably attached onto a rear surface of a lid of a main body of a printer, the printer can be small sized.

Features and advantages of the present invention will be apparent from the following detailed description when read in conjunction with the accompanying drawings.

DESCRIPTION OF THE PREFERRED EMBODIMENTS

Figure 1:
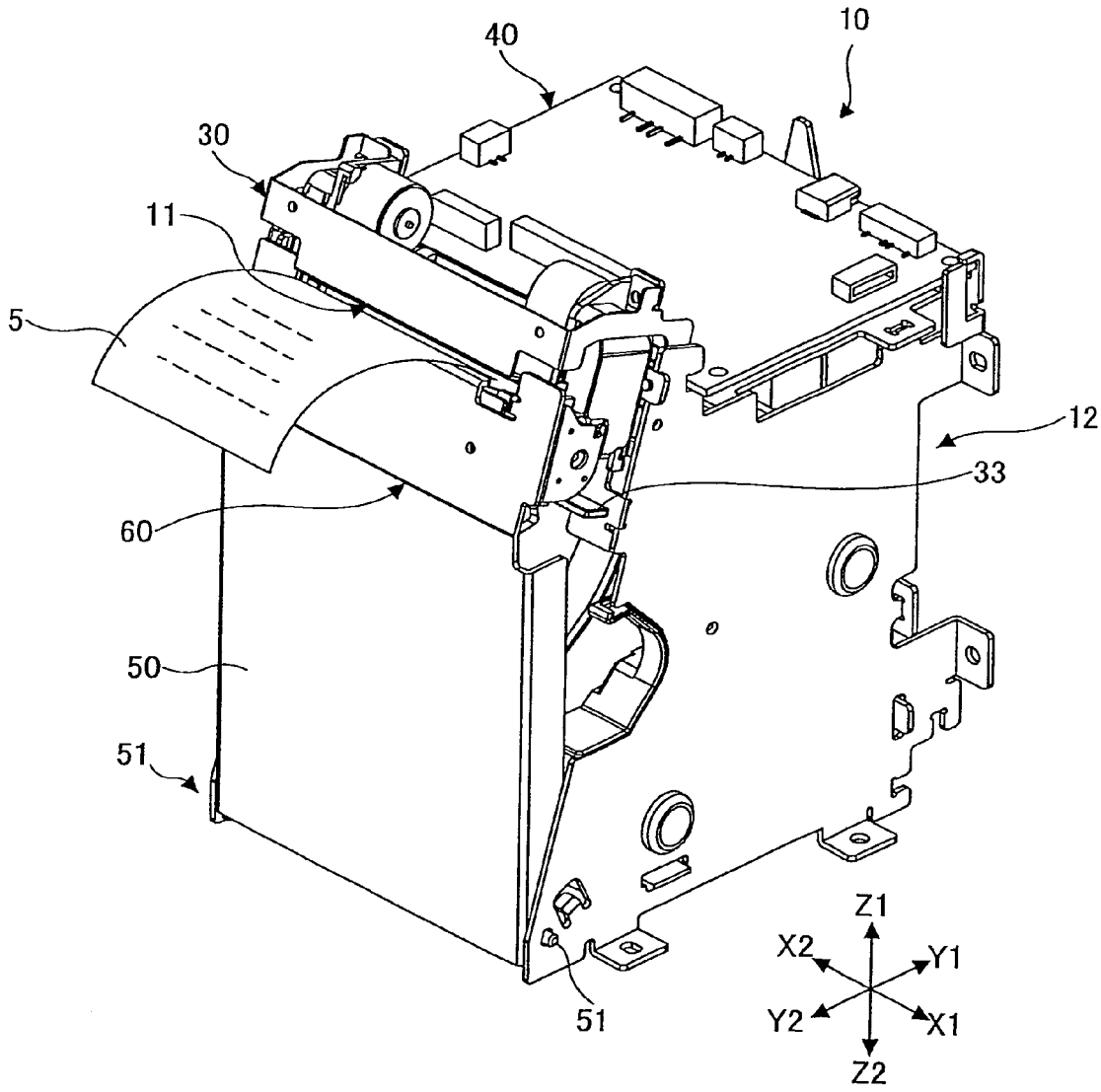
FIG. 1 is a perspective view of a thermal printer according to a first embodiment of the present invention.

Referring to the drawings, embodiments of the present invention are described. In the embodiments of the present invention, as a printer, a thermal printer is used; however, the printer is not limited to the thermal printer and the embodiments of the present invention can be applied to any printer.

First Embodiment

First, a first embodiment of the present invention is described.

[Structure of Thermal Printer]

Figure 2:
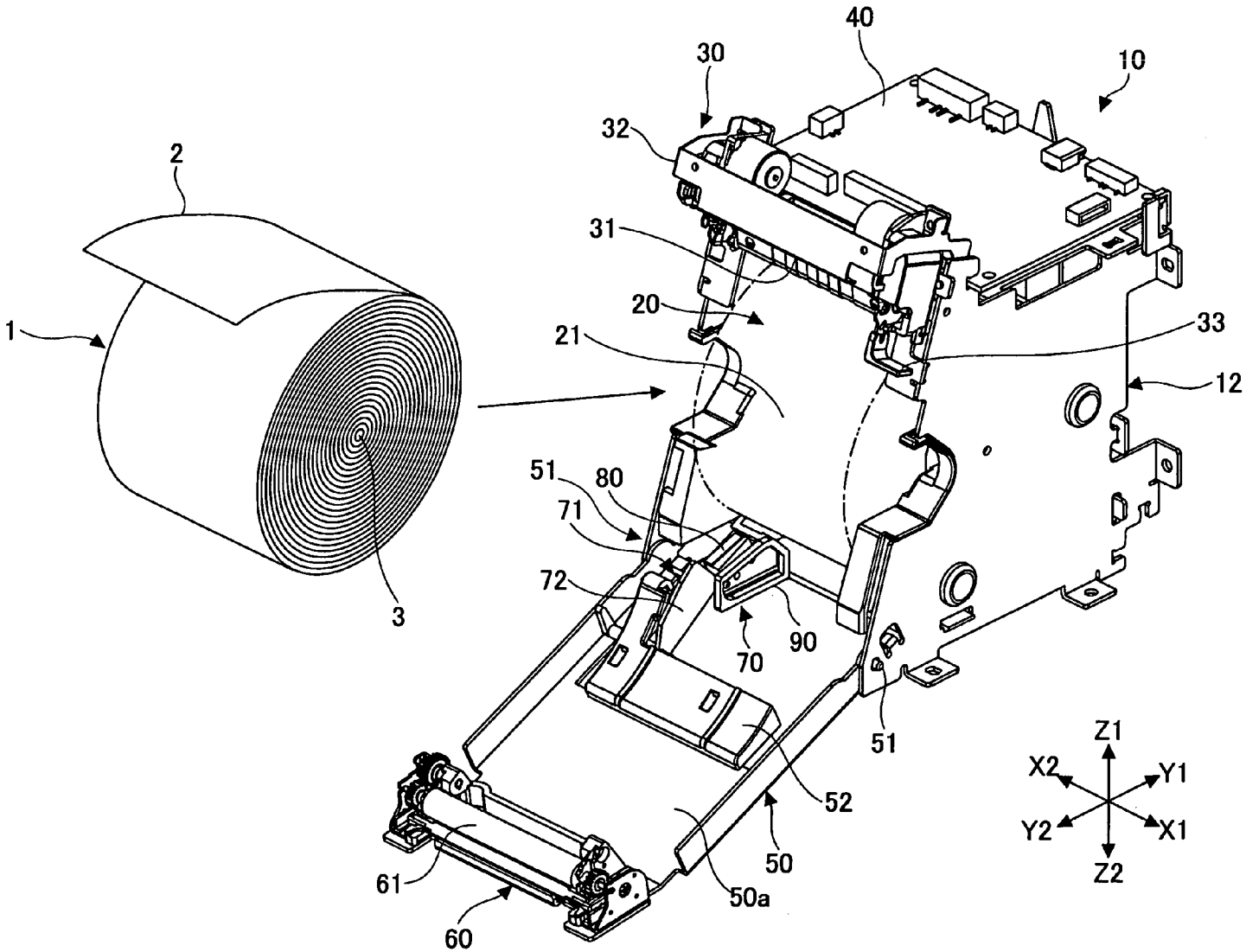
FIG. 2 is a perspective view of the thermal printer in which a lid is opened according to the first embodiment of the present invention.
Figure 3:
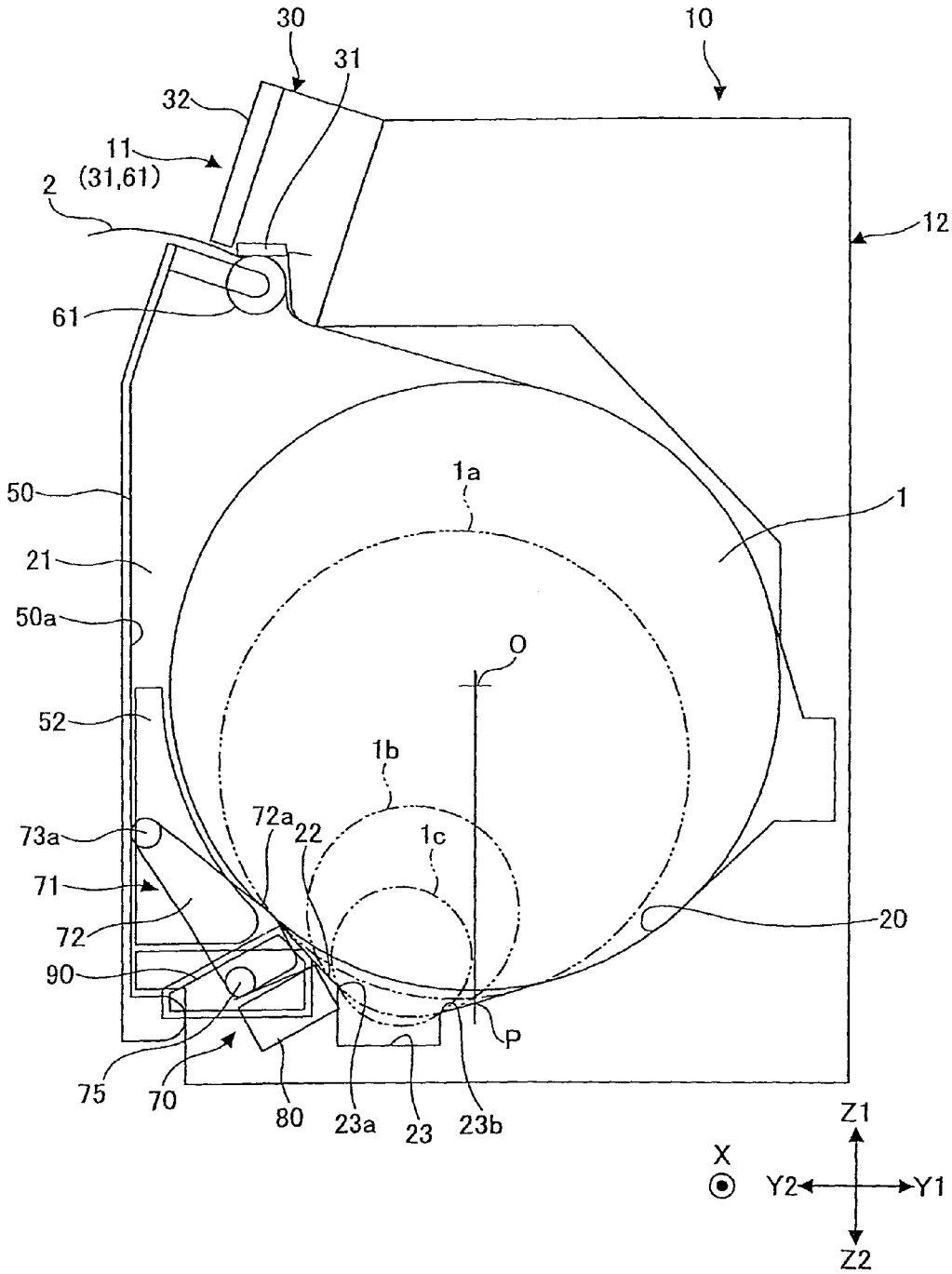
FIG. 3 is a cut-away side view of a part of the thermal printer shown in FIG. 1.
Figure 4:
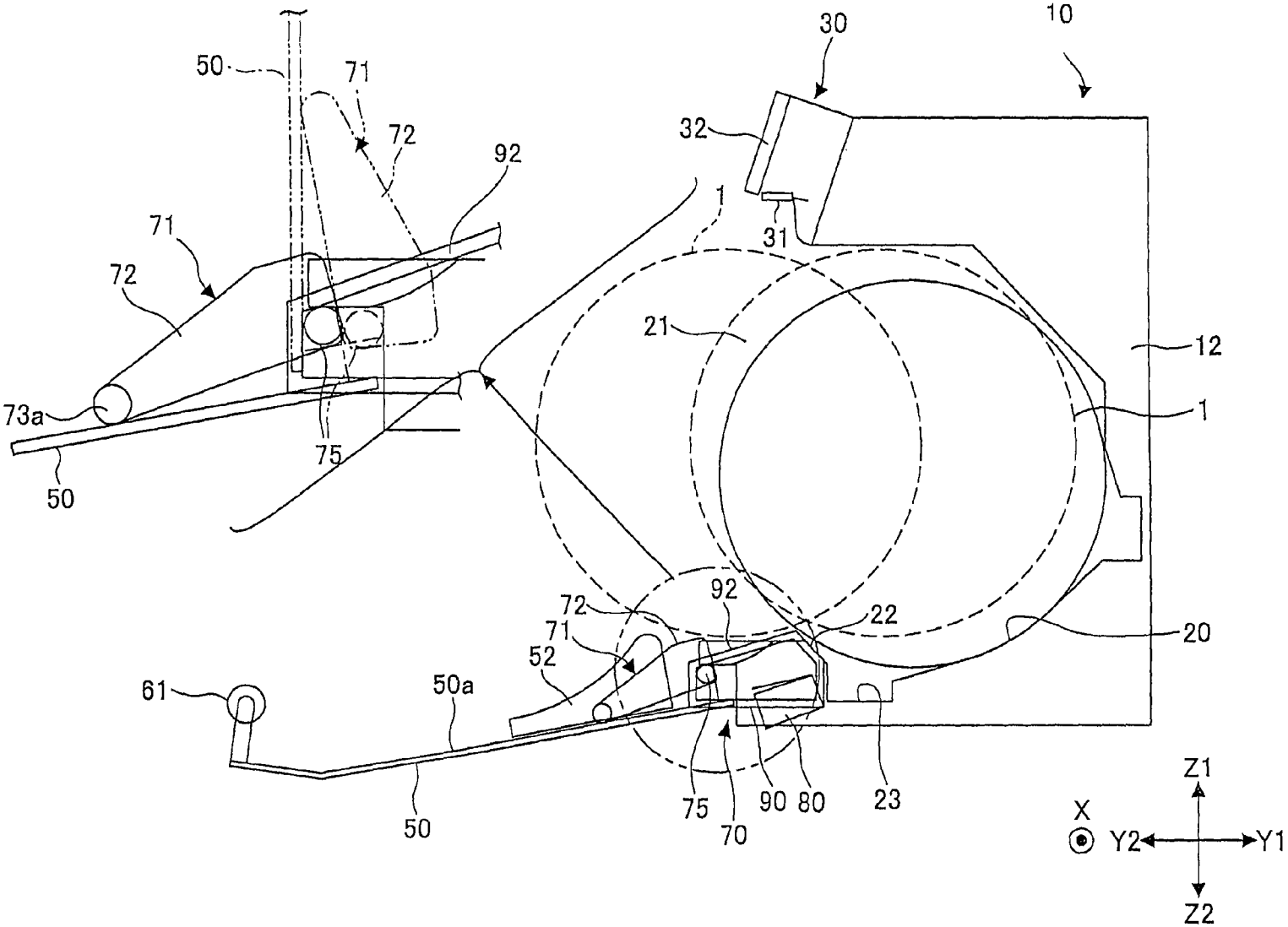
FIG. 4 is a cut-away side view of a part of the thermal printer shown in FIG. 2.

FIG. 1 is a perspective view of a thermal printer 10 according to a first embodiment of the present invention. FIG. 2 is a perspective view of the thermal printer 10 in which a lid 50 is opened according to the first embodiment of the present invention. FIG. 3 is a cut-away side view of a part of the thermal printer 10 shown in FIG. 1. FIG. 4 is a cut-away side view of a part of the thermal printer 10 shown in FIG. 2. In FIG. 1, the thermal printer 10 is shown in use. The thermal printer 10 includes an easy loading mechanism in which a thermosensitive paper roll is easily loaded in the thermal printer 10 and a near-end detecting mechanism 70 for detecting the near-end state of the thermosensitive paper roll. The thermal printer 10 can be installed in, for example, a POS apparatus. In the drawings, X1-X2 is the width direction of the thermal printer 10, Y1-Y2 is the length direction of the thermal printer 10, and Z1-Z2 is the height direction of the thermal printer 10. The Y2 side is the front side of the thermal printer 10 and a user can operate the thermal printer from the front side. In the following, in some cases, the Y1-Y2 direction is simply referred to as the Y direction, the X1-X2 direction is simply referred to as the X direction, and the Z1-Z2 direction is simply referred to as the Z direction.

As shown in FIGS. 1 through 4, the thermal printer 10 includes a main body 12 whose shape is almost a box, and the lid 50 of a plate shape which is rotatably held by the main body 12 with shafts 51 of the lid 50 as the center. When a thermosensitive paper roll 1 (hereinafter referred to as a paper roll 1) is loaded in a thermosensitive paper roll container 20 (hereinafter referred to as a paper roll container 20) and the lid 50 is closed, a letter (image) printing mechanism 11 works. The thermal printer 10 is, for example, a receipt printing apparatus which forms a receipt 5, and is used as shown in FIG. 1.

[Easy Loading Mechanism]

The Y2 side of the main body 12 is an opening section 21, and the paper roll container 20 is formed in the main body 12 as a cavity. A thermal head module 30 is secured to the main body 12 at the Z1 and Y2 ends by contacting the opening section 21 at the Z1 side. A circuit board module 40 is secured onto the upper surface of the main body 12. The thermal head module 30 includes a thermal head 31 and an automatic paper cutter mechanism 32. The automatic paper cutter mechanism 32 includes a motor (not shown) and a movable blade (not shown). The circuit board module 40 includes circuits such as a letter (image) printing circuit, an automatic paper cutter mechanism driving circuit, and a near-end detecting mechanism driving circuit for driving the near-end detecting mechanism 70 which is connected to a detecting switch 80 (described below).

The paper roll container 20 has a size in which the paper roll 1 can be contained at a position where a winding center 3 of the paper roll 1 is extended in the X1-X2 direction. The paper roll 1 is formed by winding belt-shaped thermosensitive paper 2 around the winding center 3. The opening section 21 is disposed at the Y2 side of the paper roll container 20. The deepest position of the bottom surface of the paper roll container 20 is at a position nearer to the opening section 21 instead of at the position "P" right under the center "O" of the paper roll container 20, and the paper roll container 20 includes a front side holder 22 for holding the paper roll 1 so that the paper roll 1 does not drop from the paper roller container 20.

In addition, in the paper roll container 20, at the deepest position of the bottom surface, a groove 23 (concave section) is formed in the X1-X2 direction in the entire width of the paper roll container 20. The groove 23 provides two brims 23*a* and 23*b* extended in the X direction so that the two brims 23*a* and 23*b* are disposed away from each other in the Y direction. The two brims 23*a* and 23*b* work for positioning the paper roll 1 to a position close to an arm main body 72 (described below) when the paper roll 1 approaches the near-end state. As described above, when the remaining amount of the thermosensitive paper 2 becomes approximately 1 to 2 meters, this is called the near-end state.

The paper roll 1 is rotated while being sustained by the bottom surface of the paper roll container 20, and is reduced in size to the size of a paper roll 1*a* and to a paper roll 1*b* while the thermosensitive paper 2 is being used caused by the corresponding changes of the diameter of the paper roll 1. When the size of the paper roll 1 is reduced to that of the paper roll 1*b*, two positions on the outer circumferential surface of the paper roll 1*b* are sustained by the brims 23*a* and 23*b*, and the paper roll 1*b* is rotated by being sustained at the position of the groove 23. Further, when the size of the paper roll 1*b* is reduced to that of a paper roll 1*c* in the near-end state, a part of the paper roll 1*c* enters the groove 23 and the two positions of the outer circumferential surface of the paper roll 1*c* are sustained by the brims 23*a* and 23*b*.

The lid 50 is rotatably held by the main body 12 with the shafts 51 of the lid 50 as the center. In FIG. 1, the lid 50 is closed and is at the vertical position, and in FIG. 2, the lid 50 is opened and is at the approximately horizontal position. A platen roller module 60 is secured at the tip of the lid 50, and an auxiliary holder member 52 is secured on the rear surface of the lid 50. When the lid 50 is closed, the platen roller module 60 is locked with the thermal head module 30, the letter printing mechanism 11 is formed in which a platen roller 61 pushes the thermal head 31, and the opening section 21 is closed.

In order to load the paper roll 1 in the paper roll container 20, a user executes easy loading operations. In the easy loading operations, first, the user unlocks the lid 50 by operating a lock releasing lever 33 and opens the lid 50 as shown in FIG. 2. Then the user takes out the paper roll 1 whose thermosensitive paper 2 is used up (the remaining amount is approximately 1 to 2 meters or less) from the paper roll container 20, and puts a new paper roll 1 in the paper roll container 20 so that the tip of the thermosensitive paper 2 gets over the front side holder 22 and further moves in the Z1 direction. The user grasps the tip of the thermosensitive paper 1, pulls out the tip of the thermosensitive paper 1 along the thermal head module 30, and closes the lid 50.

By the easy loading operations, when the lid 50 is closed, the platen roller module 60 is locked with the thermal head module 30 and the opening section 21 is closed. With this, the paper roll 1 is loaded in the paper roll container 20, and the outer circumferential surface of the paper roll 1 in the Y2 and Z2 directions contacts the auxiliary holder member 52. The thermosensitive paper 2 is sandwiched between the platen roller 61 and the thermal head 31. That is, the platen roller 61 pushes the thermosensitive paper 2 to the thermal head 31. With this, the letter printing mechanism 11 is formed and letters (image) can be printed again on the thermosensitive paper 2.

[Printing Letter Operations]

The thermal head 31 is driven by a print instruction, the platen roller 61 is rotated by a motor (not shown), the thermal head 31 prints letters (image) on the thermosensitive paper 2, and the thermosensitive paper 2 on which the letters are printed is output by the platen roller 61. As shown in FIG. 1, the receipt 5 on which the letters are printed is output from the thermal printer 10. The paper roll 1 is rotated by being sustained by the bottom part of the paper roll container 20 corresponding to the output of the thermosensitive paper 2 (the receipt 5).

The thermosensitive paper 2 is cut by the automatic paper cutting mechanism 32 and the receipt 5 is output.

[Near-End Detecting Mechanism]

Next, referring to the drawings, the near-end detecting mechanism 70 is described in detail.

Figure 5:
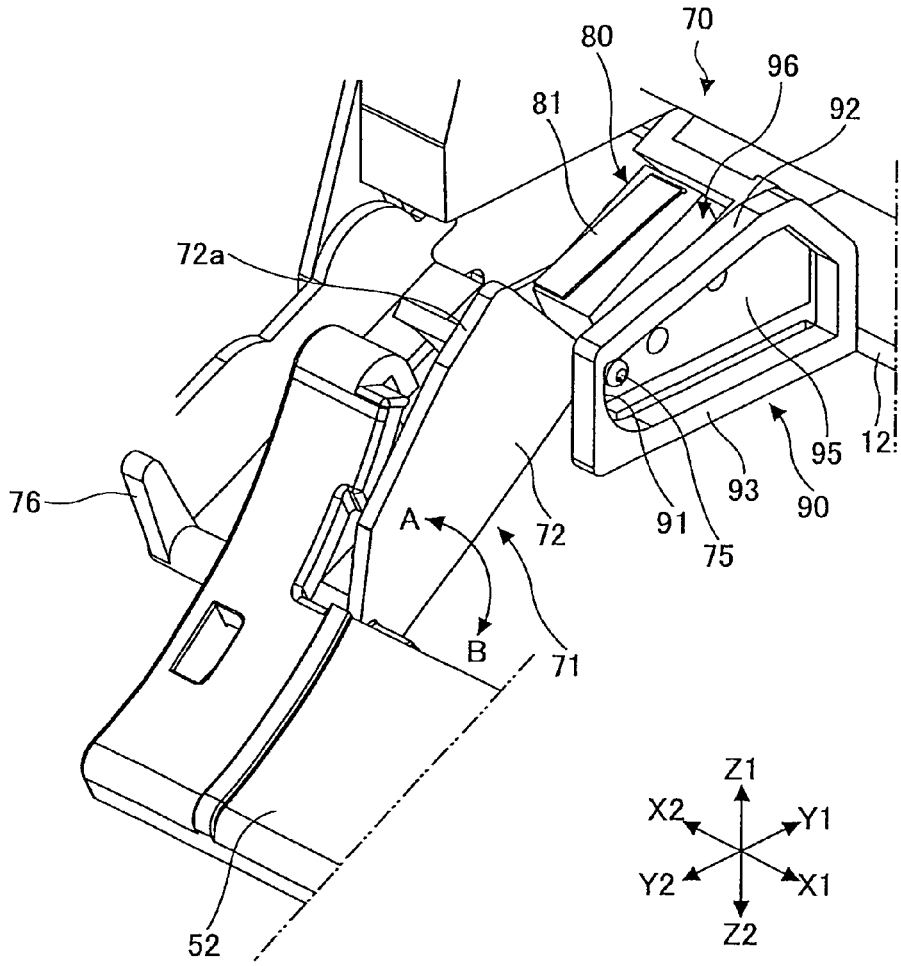
FIG. 5 is an enlarged perspective view of a near-end detecting mechanism shown in FIG. 2.
Figure 6:
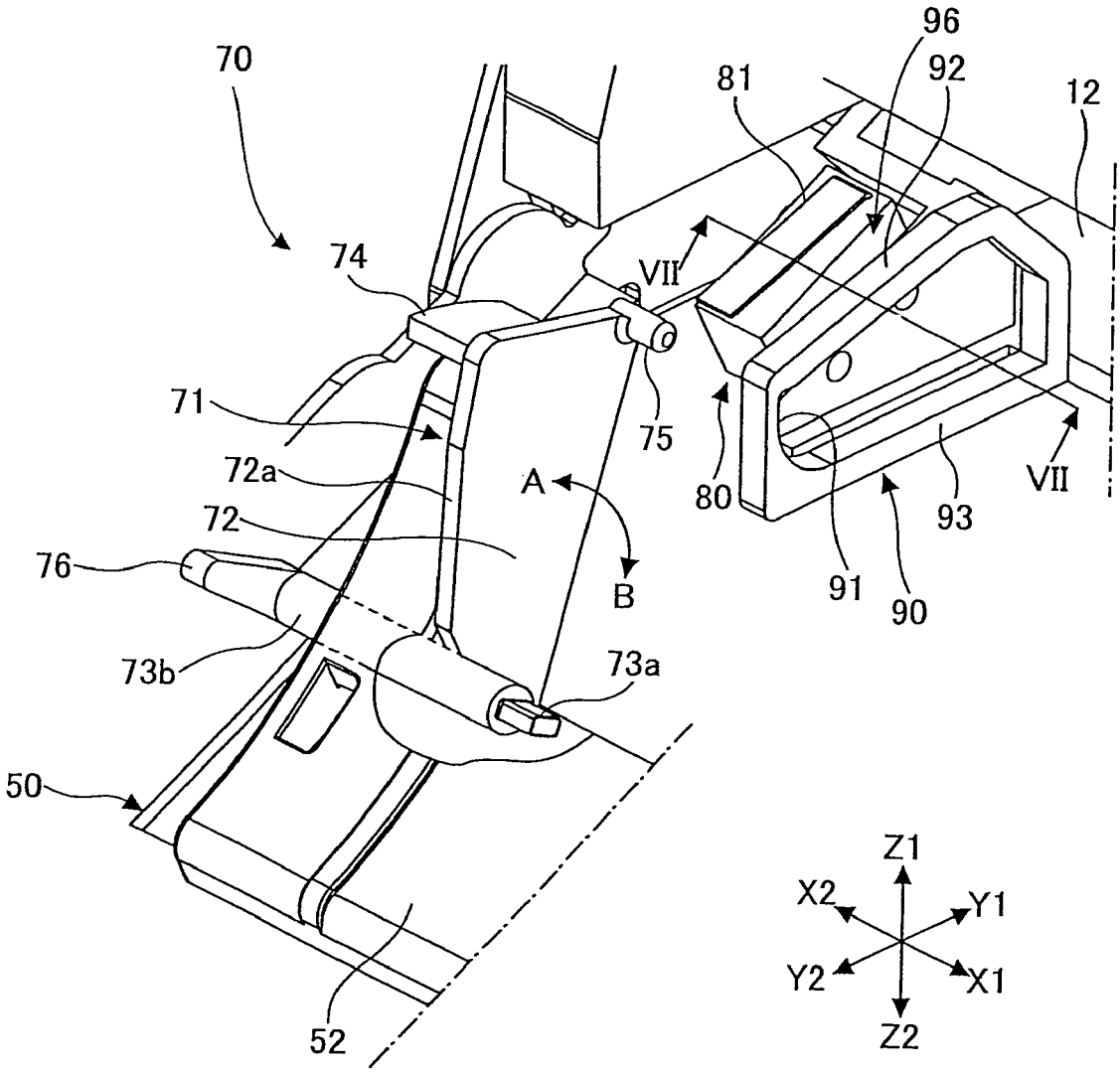
FIG. 6 is an exploded perspective view of the near-end detecting mechanism shown in FIG. 2.
Figure 7:
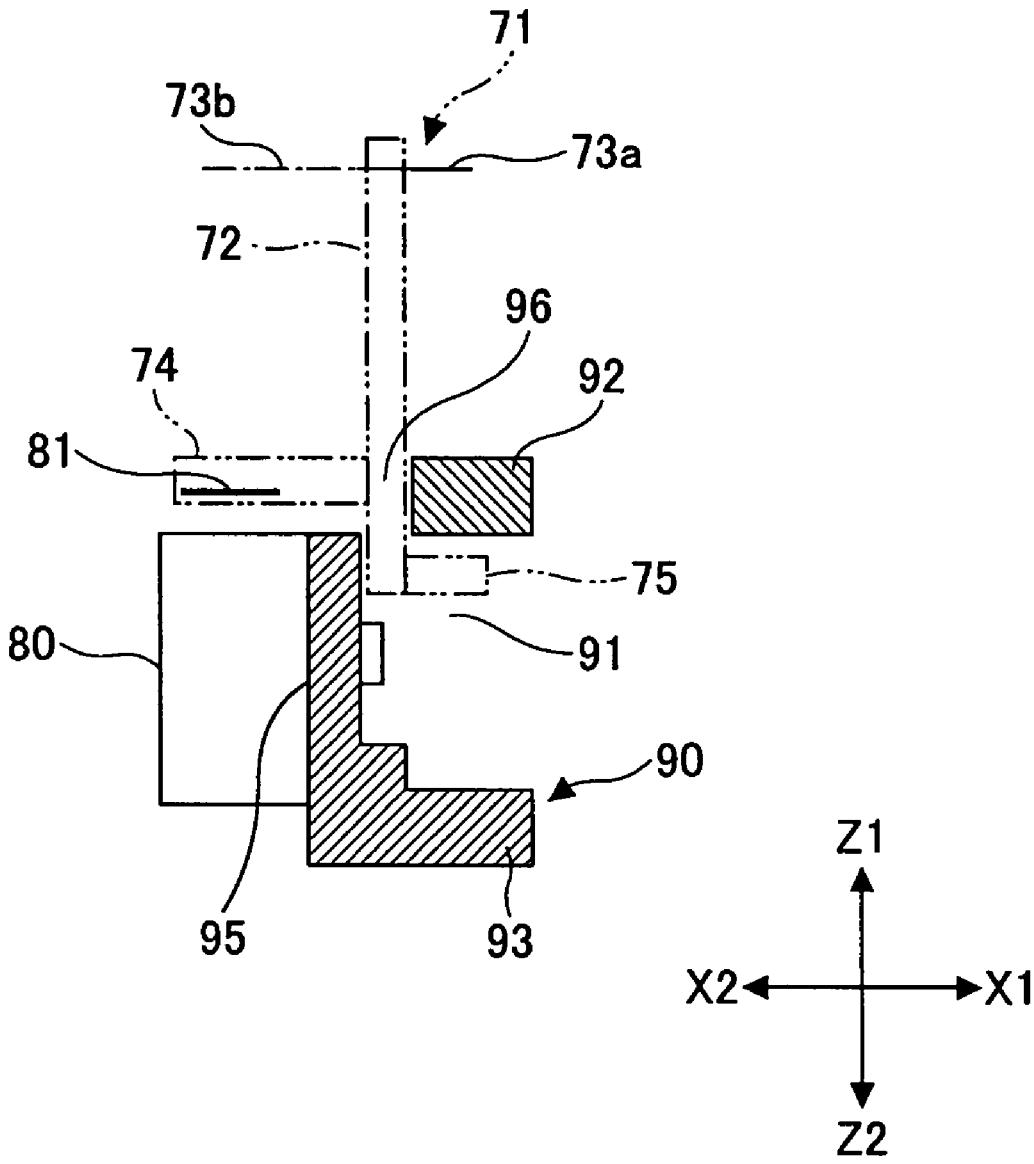
FIG. 7 is a cross-sectional view of the near-end detecting mechanism shown in FIG. 6 along line VII-VII.

FIG. 5 is an enlarged perspective view of the near-end detecting mechanism 70. FIG. 6 is an exploded perspective view of the near-end detecting mechanism 70. FIG. 7 is a cross-sectional view of the near-end detecting mechanism 70 shown in FIG. 6 along line VII-VII. The near-end detecting mechanism 70 includes a detecting arm 71, a detecting switch 80, and a controlling section 90.

The detecting arm 71 is attached onto a rear surface 50*a* (refer to FIG. 2) of the lid 50, the detecting switch 80 is attached to the main body 12, and the controlling section 90 is attached to the main body 12. The detecting switch 80 is a mechanical switch including a movable plate 81 having a beam shape whose one end is held. The detecting switch 80 is normally OFF, and when the movable plate 81 is pushed against a spring force, the detecting switch 80 becomes ON.

The detecting arm 71 includes an arm main body 72 having an approximately long triangle shape, shafts 73*a* and 73*b*, an extending part 74 having an arc shape, a protrusion 75, and a lever 76. The shafts 73*a* and 73*b* are extended in the corresponding X1 and X2 directions from the one end of the arm main body 72, the extending part 74 extends in the X2 direction from the rear surface of the arm main body 72, the protrusion 75 extends in the X1 direction from the other end of the arm main body 72, and the lever 76 is attached to the shaft 73*b*. An end surface 72*a* of the arm main body 72 contacts the n outer circumferential surface of the paper roll 1.

The shafts 73*a* and 73*b* of the detecting arm 71 are held by a holder member 77 (refer to FIG. 8) secured to the rear surface of the lid 50. Further, the detecting arm 71 is pushed on the rear surface of the auxiliary holder member 52 (refer to FIG. 2) and is rotatably held in the arrow direction A-B on the Y-Z surface with the shafts 73*a* and 73*b* as the center. In addition, the detecting arm 71 is pushed in the arrow direction A by a spring (not shown). That is, the detecting arm 71 is pushed in the direction where the arm main body 72 rises up to the rear surface of the lid 50. The detecting arm 71 is disposed at a position near the shaft 51 of the X2 side. That is, the detecting arm 71 continues to contact the outer circumferential surface of the paper roll 1 until the paper roll 1 reaches the near-end state, and does not obstruct loading the paper roll 1 in the paper roll container 20.

The controlling section 90 protrudes in the Y2 direction from the Z2 side end of the opening section 21 of the main body 12 and is an approximately triangle-shaped frame whose inside is an opening part 91. Further, the controlling section 90 includes a slanting part 92 at the Z1 side and a bottom part 93 which is approximately horizontal at the Z2 side. The inside surface of the slanting part 92 is formed approximately along the moving excursion route of the protrusion 75 with the shafts 73*a* and 73*b* as the center when the lid 50 is closed. With this, when the lid 50 is opened, the inside surface of the slanting part 92 prevents the detecting arm 71 from further moving in the arrow direction A. When the lid 50 is closed, since the shafts 73*a* and 73*b* move to the upper position of the slanting part 92, the detecting arm 71 is prevented from being rotated. In FIG. 6, since FIG. 6 is an exploded perspective view, the protrusion 75 is not shown engaged in the opening part 91 of the controlling section 90; however, actually, as shown in FIG. 5, the protrusion 75 is engaged in the opening part 91 of the controlling section 90.

As shown in FIG. 7, a wall part 95 to which the detecting switch 80 is attached protrudes in the X2 direction from the bottom part 93. That is, the wall part 95 connects to the bottom part 93. The detecting switch 80 is screwed in the X2 side of the wall part 95 so that the movable plate 81 of the detecting switch 80 is at the upper position. A gap 96 is formed between the wall part 95 and the slanting part 92 so that the tip of the arm main body 72 is inserted into the gap 96. With this, the arm main body 72 is rotated while the tip of the arm main body 72 is prevented from being moved in the X direction.

As shown in FIGS. 4 and 5, when the lid 50 is opened, since the tip of the arm main body 72 is inserted into the gap 96 and the protrusion 75 is engaged into the opening part 91 of the controlling section 90 and is stopped on the inside surface of the slanting part 92, the detecting arm 71 is rotated in the arrow direction B against the spring force. That is, the detecting arm 71 is prevented from being rotated in the arrow direction A and is in the auxiliary holder member 52 taken from the X1 side. In other words, the arm main body 72 is at a position outside the route where the paper roll 1 is loaded in the paper roll container 20; that is, the arm main body 72 is at a position where it does not obstruct loading the paper roll 1 in the paper roll container 20.

Since the detecting arm 71 does not protrude from the auxiliary holder member 52 and is at the position near the shaft 51 (refer to FIG. 2) of the X2 side, the detecting arm 71 does not obstruct loading the paper roll 1 in the paper roll container 20.

Figure 8:
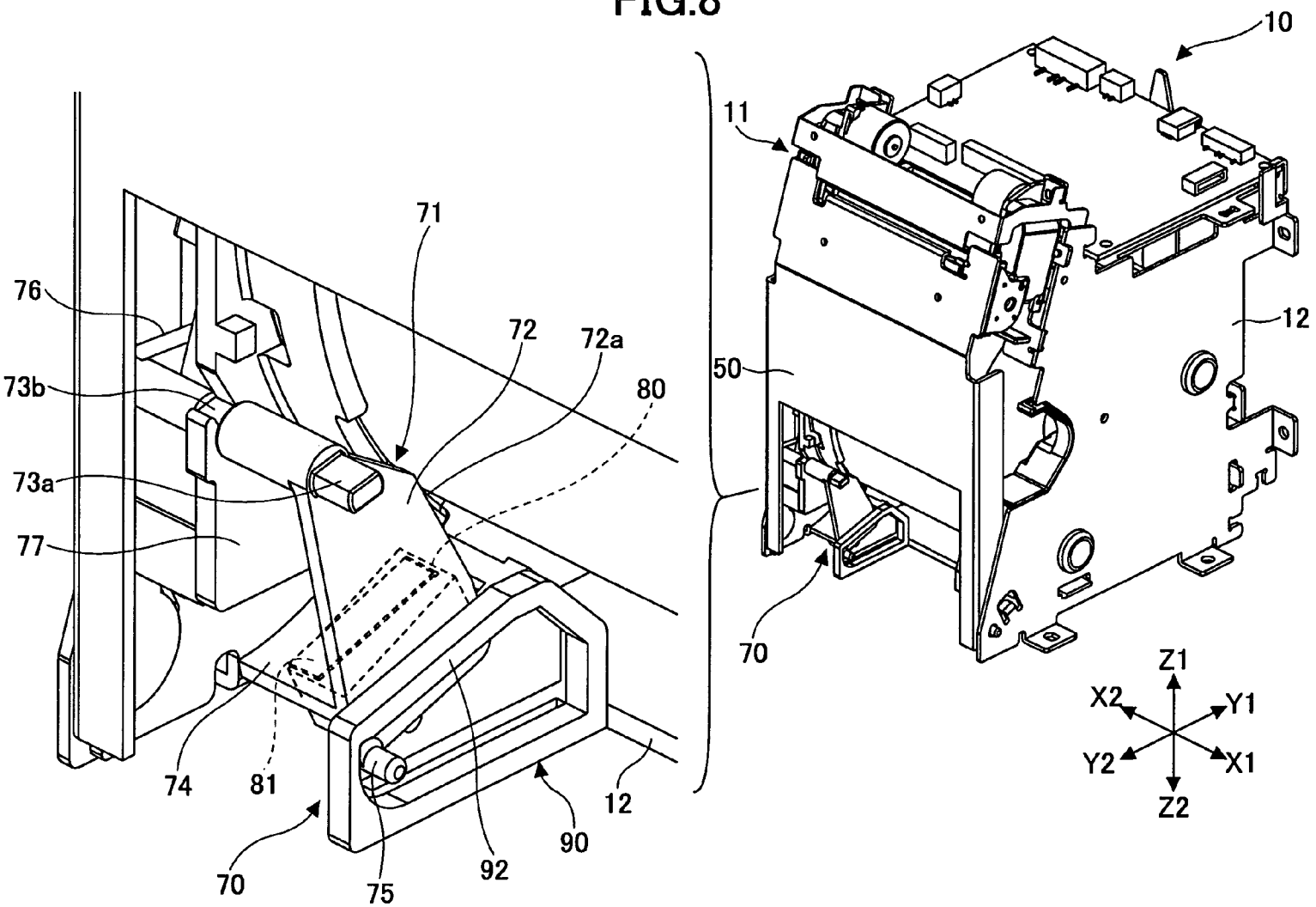
FIG. 8 is a perspective view of the thermal printer and the near-end detecting mechanism when the lid is closed according to the first embodiment of the present invention.
Figure 9:
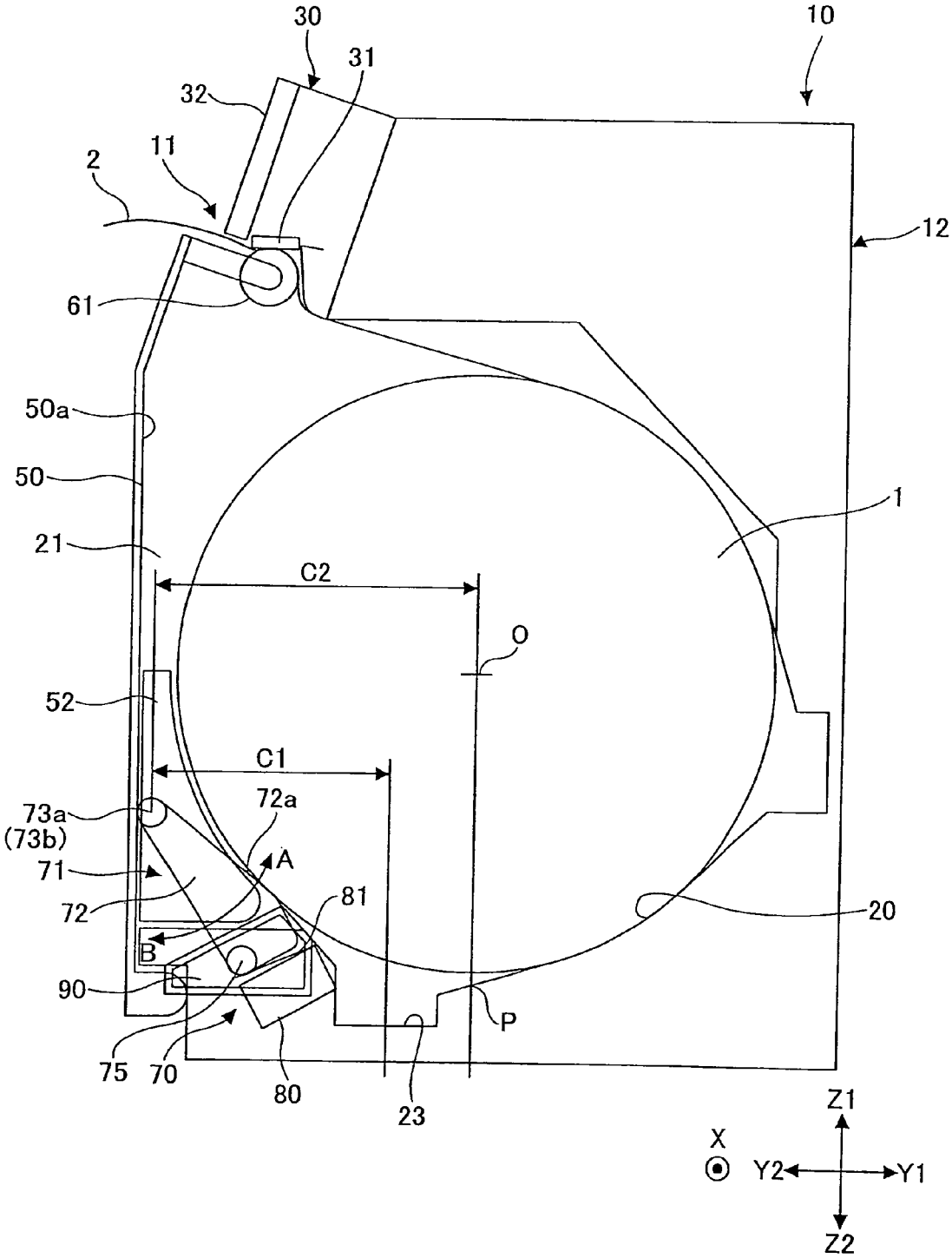
FIG. 9 is a cut-away side view of a part of the thermal printer shown in FIG. 8.

When a new paper roll 1 is loaded in the paper roll container 20 and the lid 50 is closed, the near-end detecting mechanism 70 is in the position shown in FIGS. 8 and 9. FIG. 8 is a perspective view of the thermal printer 10 and the near-end detecting mechanism 70 when the lid 50 is closed. FIG. 9 is a cut-away side view of the thermal printer 10 and the near-end detecting mechanism 70 when the lid 50 is closed.

At a stage before the lid 50 is completely closed, the end surface 72*a* of the arm main body 72 contacts the outer circumferential surface of the new paper roll 1 in the paper roll container 20, and the end surface 72*a* of the arm main body 72 is prevented from being excessively moved in the Y1 direction. In a process when the lid 50 is completely closed, the detecting arm 71 is slightly moved in the arrow direction B relative to the lid 50.

The relationship between the detecting arm 71 and the controlling section 90 is described below in detail. When the lid 50 is closed, the protrusion 75 moves in the Z2 direction for the controlling section 90 and does not contact the inside surface of the slanting part 92, and the detecting arm 71 is released from the control from the controlling section 90. While the diameter of the paper roll 1 becomes small, the detecting arm 71 can be moved in the arrow direction A by the spring force.

The relationship between the detecting arm 71 and the detecting switch 80 is described below in detail. When the lid 50 is closed, the extending part 74 pushes the movable plate 81, and the detecting switch 80 becomes ON.

As shown in FIGS. 8 and 9, in the relationship between the detecting arm 71 and the groove 23, the distance between the shafts 73*a* and 73*b* of the detecting arm 71 and the center of the groove 23 is "C1" in the Y direction. The distance "C1" is approximately ⅔ of the distance "C2" between the shafts 73*a* and 73*b* of the detecting arm 71 and the center "O" of the paper roll container 20 in the Y direction; that is, the distance "C1" is less than the distance "C2". As described above, the groove 23 is at a position nearer the detecting arm 71 than the position "P" right under the center of the paper roll container 20 in the Y direction.

When printing letters is started and the thermosensitive paper 2 is pulled out, the paper roll 1 is rotated in the counterclockwise direction. At this time, a friction force is generated on the detecting arm 71 by friction between the outer circumferential surface of the paper roll 1 and the detection arm 71. When the friction force is generated in a direction which causes the arm main body 72 to move the shafts 73*a* and 73*b*, in some cases, the friction force becomes unstable and unintentionally large, so that pulling out the thermosensitive paper 2 by the platen roller 61 may be unstable. However, in the first embodiment of the present invention, since the friction force is generated in a direction which causes the arm main body 72 to move apart from the shafts 73*a* and 73*b*, the friction force is small and stable, so that the thermosensitive paper 2 can be stably pulled out by the platen roller 61.

While printing letters on the thermosensitive paper 2 is continued and the diameter of the paper roll 1 becomes smaller, the detecting arm 71 is gradually rotated in the arrow direction A. The extending part 74 moves to the held part of the movable plate 81. The paper roll 1 gradually moves in the bottom direction of the paper roll container 20. When the paper roll 1 approaches the near-end state, a part of the paper roll 1 enters the groove 23 and continues to rotate at the position by being positioned at the groove 23. While the diameter of the paper roll 1 becomes smaller, the part of the outer circumferential surface of the paper roll 1 at the side of the detecting arm 71 moves in the Y1 direction, that is, in the direction apart from the detecting arm 71. In addition, when the paper roll 1 further approaches the near-end state and the end of the extending part 74 approaches the held part of the movable plate 81, the movable plate 81 starts to be opened (the detecting switch 80 approaches OFF).

Figure 10:
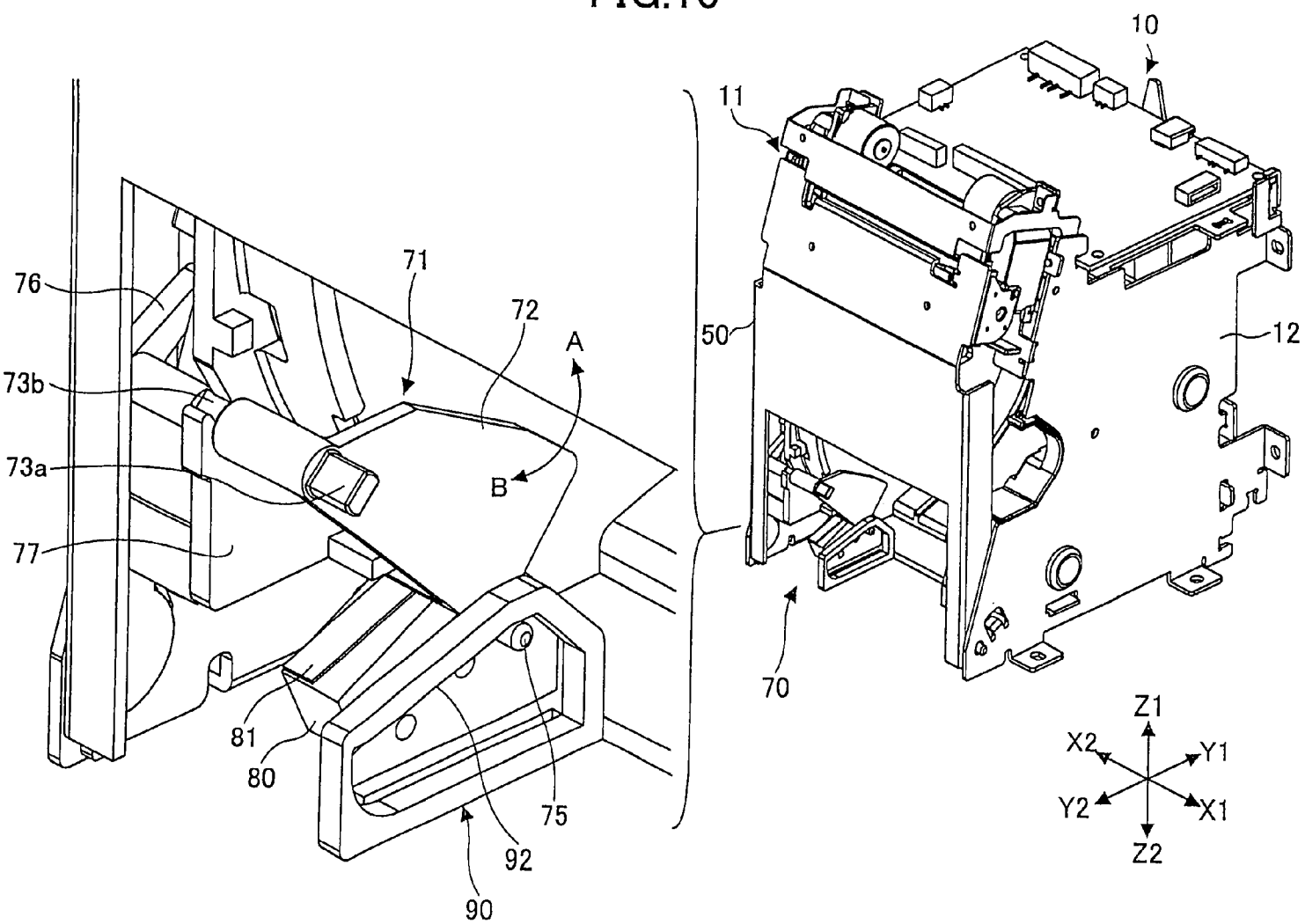
FIG. 10 is a perspective view of the thermal printer and the near-end detecting mechanism in a near-end state of a paper roll according to the first embodiment of the present invention.
Figure 11:
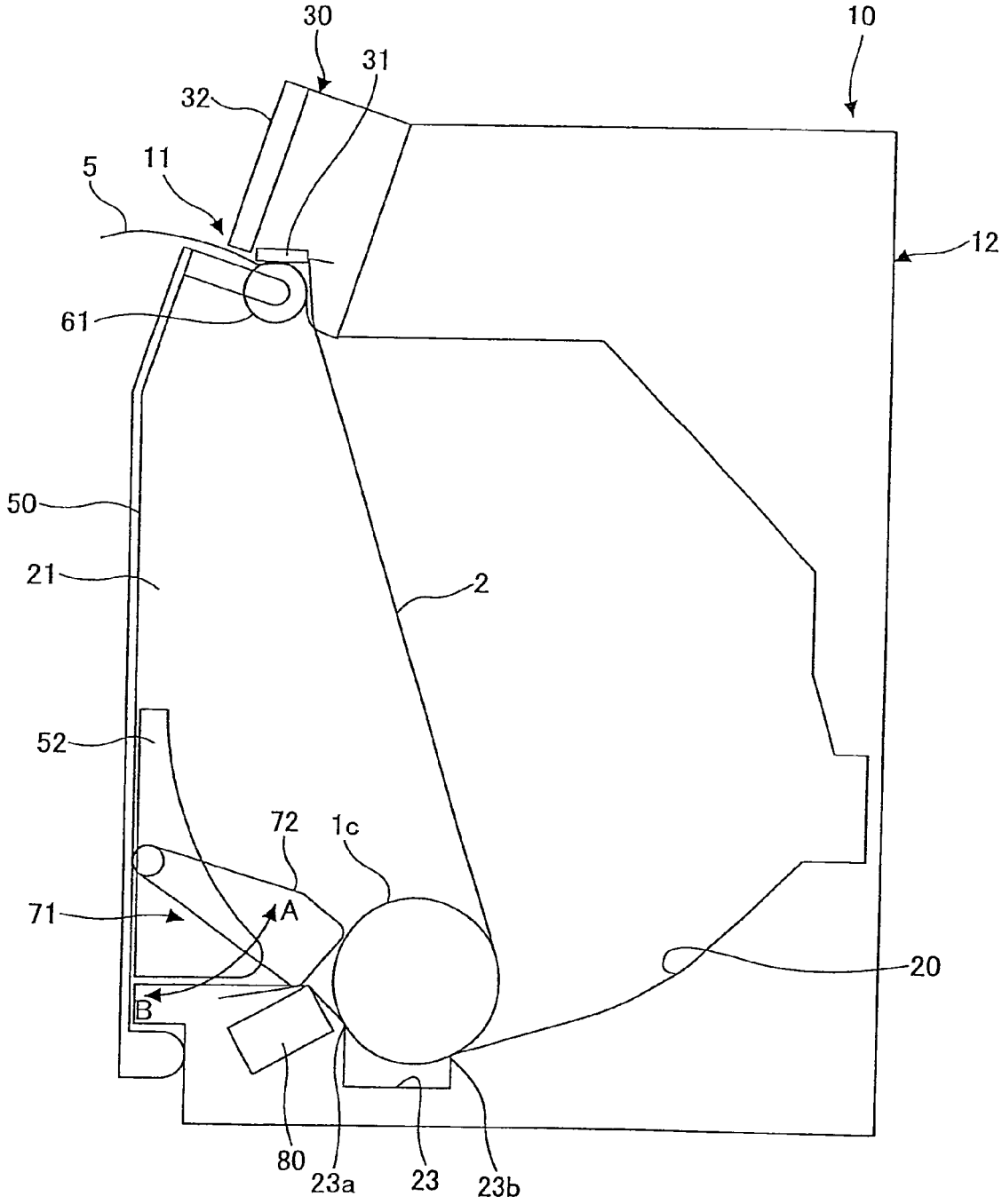
FIG. 11 is a cut-away side view of the thermal printer and the near-end detecting mechanism in the near-end state of the paper roll shown in FIG. 10.

When the paper roll 1 reaches the near-end state, the outer circumferential surface of the paper roll 1 moves to a position where the detecting arm 71 does not contact the paper roll 1, the detecting arm 71 is not stopped by the outer circumferential surface of the paper roll 1 and is rotated to a predetermined position by a predetermined angle in the arrow direction A shown in FIGS. 10 and 11. By this rotation of the detecting arm 71, the extending part 74 is separated from the detecting switch 80 in the Y2 direction, the movable plate 81 is opened, and the detecting switch 80 becomes OFF. FIG. 10 is a perspective view of the thermal printer 10 and the near-end detecting mechanism 70 in the near-end state. FIG. 11 is a cut-away side view of the thermal printer 10 and the near-end detecting mechanism 70 in the near-end state.

When the detecting switch 80 becomes OFF, a circuit in the circuit board module 40 reports to the user that the paper roll 1 has reaches the near-end state.

Printing letters can be continued on the thermosensitive paper 2 even after the near-end state has been reached. The user exchanges the paper roll 1 at a suitable timing. When printing letters is continued by not changing the paper roll 1, printing letters is automatically stopped right before the end of thermosensitive paper 2 reaches the thermal head 31.

When the lid 50 is opened, while the shafts 73*a* and 73*b* move to the Y2 side from the controlling section 90, the protrusion 75 moves in the Y2 direction in contact with the inside surface of the slanting part 92, and the detecting arm 71 is rotated in the arrow direction B against the spring force and is engages in the auxiliary holder member 52 taken from the X1 direction.

Second Embodiment

Figure 12:
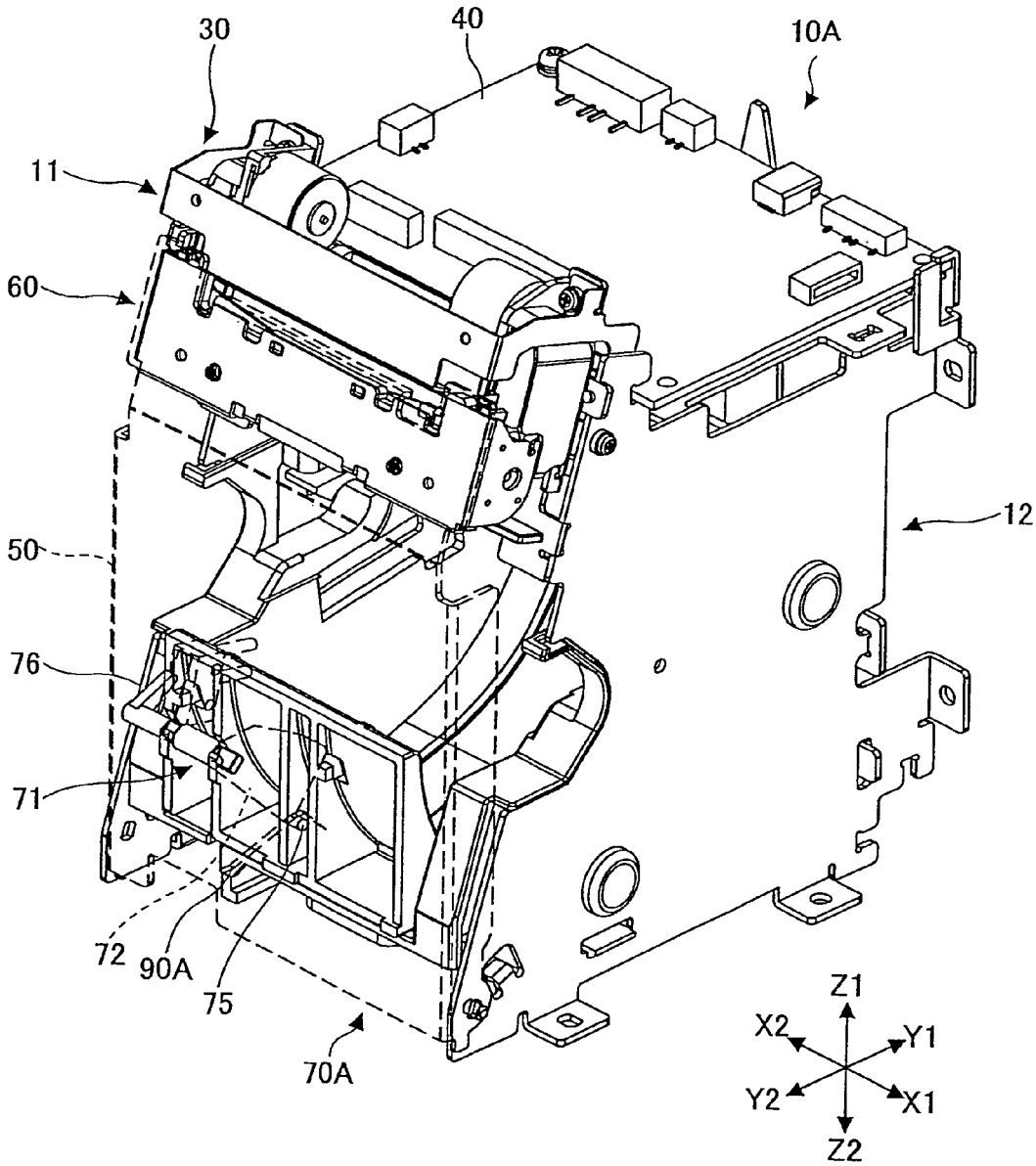
FIG. 12 is a first perspective view of a thermal printer according to a second embodiment of the present invention.
Figure 13:
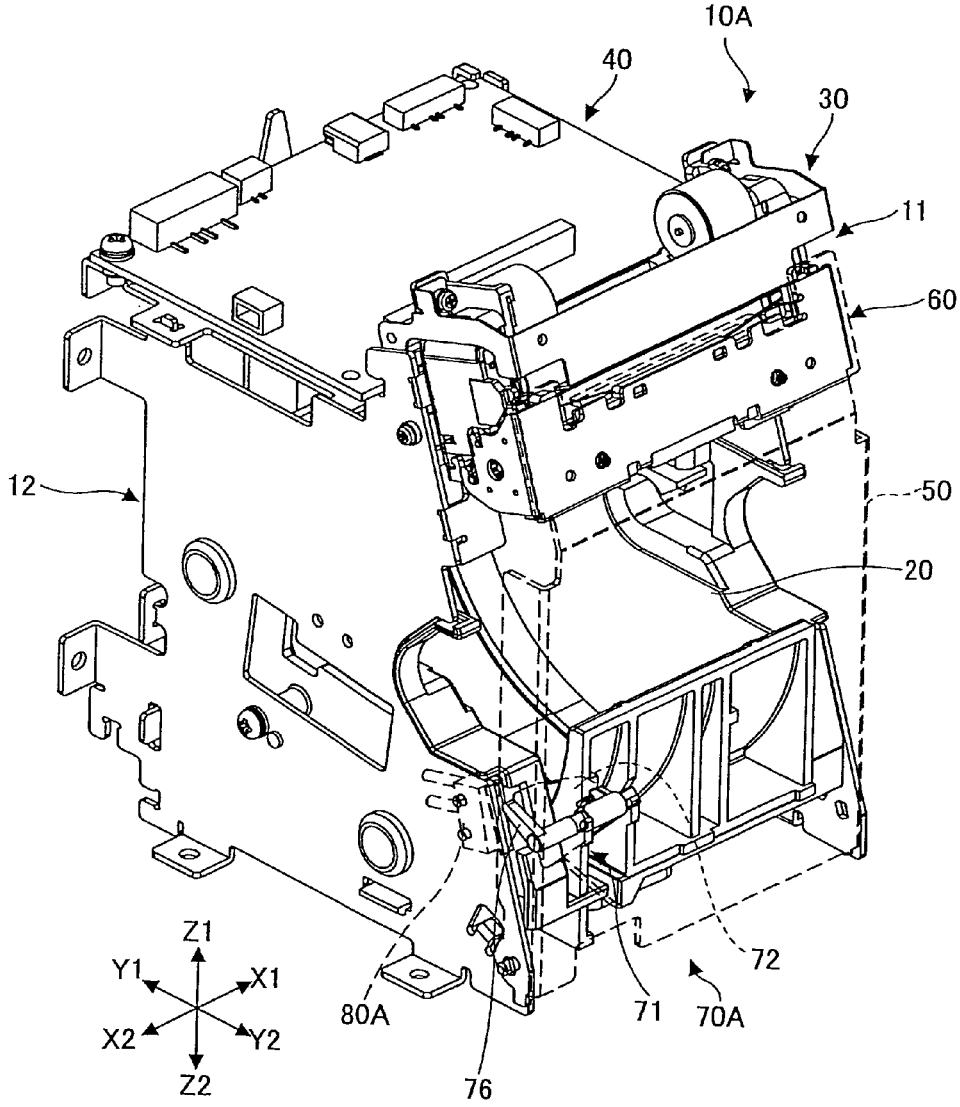
FIG. 13 is a second perspective view of the thermal printer according to the second embodiment of the present invention.
Figure 14:
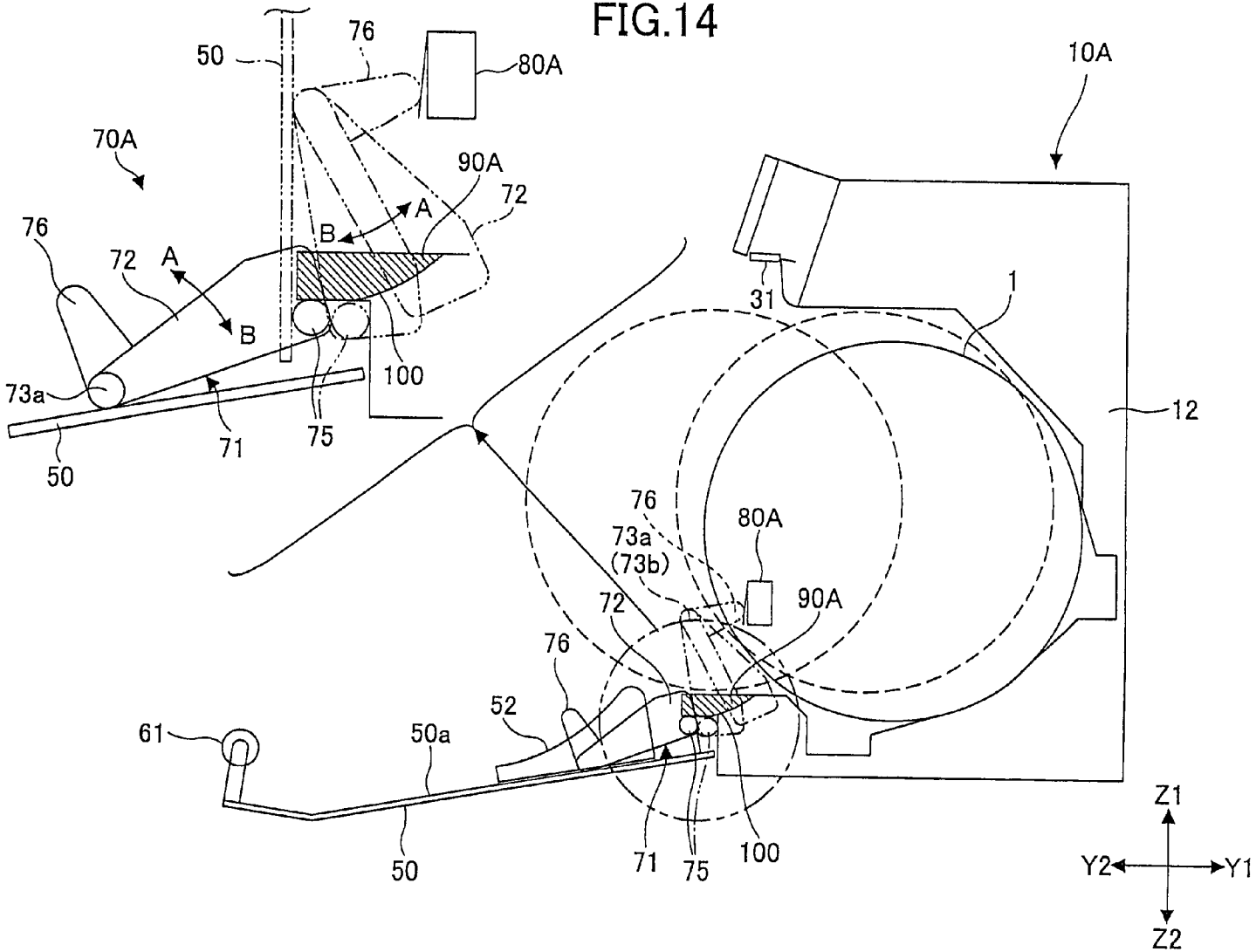
FIG. 14 is a cut-away side view of a part of the thermal printer when the lid is opened according to the second embodiment of the present invention.

Referring to the drawings, a second embodiment of the present invention is described. FIG. 12 is a first perspective view of a thermal printer 10A according to the second embodiment of the present invention. FIG. 13 is a second perspective view of the thermal printer 10A according to the second embodiment of the present invention. FIG. 14 is a cut-away side view of a part of the thermal printer 10A in which the lid 50 is opened. In FIGS. 12 and 13, the thermal printer 10A is taken from the corresponding different directions. In the second embodiment of the present invention, when a function of an element having a reference number is the same as that in the first embodiment of the present invention, the same reference number is used for the element.

The thermal printer 10A includes a near-end detecting mechanism 70A different from the near-end detecting mechanism 70 in the thermal printer 10 of the first embodiment of the present invention.

As shown in FIG. 14, in the near-end detecting mechanism 70A, a detecting switch 80A is attached onto the inner side surface of the main body 12, the lever 76 of the detecting arm 71 contacts the detecting switch 80A, and a controlling section 90A has a simple protrusion shape protruding in the Y2 direction by having a lower surface 100 of an approximately arc shape. The lower surface 100 is along the moving excursion route of the protrusion 75 with the shafts 73*a* and 73*b* as the center when the lid 50 is closed.

As shown in FIG. 14, when the lid 50 is opened, the protrusion 75 is stopped by the lower surface 100 of the controlling section 90A, and the detecting arm 71 is not rotated in the arrow direction A. When the lid 50 is closed, as shown in an alternate two-dot broken line, the lower surface 100 of the controlling section 90A cannot prevent the protrusion 75 from being moved, and the detecting arm 71 is rotated in the arrow direction A and contacts the outer circumferential surface of the paper roll 1.

When the paper roll 1 reaches the near-end state, the lever 76 does not contact the detecting switch 80A, and the detecting switch 80A becomes OFF.

Third Embodiment

Figure 15:
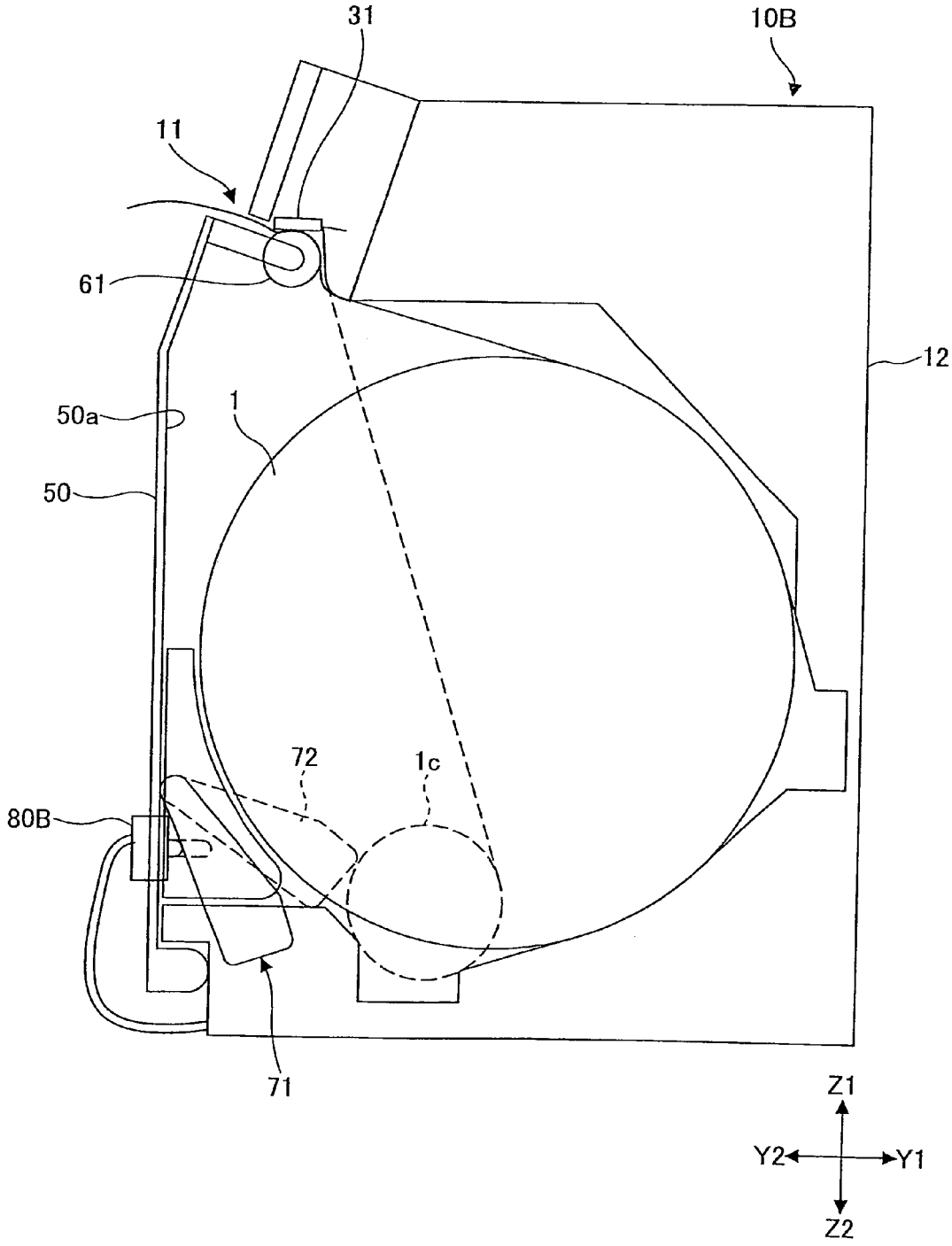
FIG. 15 is a cut-away side view of a part of a thermal printer according to a third embodiment of the present invention.

Referring to FIG. 15, a third embodiment of the present invention is described. FIG. 15 is a cut-away side view of a part of a thermal printer 10B according to the third embodiment of the present invention. In the third embodiment of the present invention, when a function of an element having a reference number is the same as that in the first embodiment of the present invention, the same reference number is used for the element.

As shown in FIG. 15, the detecting arm 71 and a detecting switch 80B are attached to the lid 50, and the other parts are the same as those in the first embodiment of the present invention.

Fourth Embodiment

Figure 16:
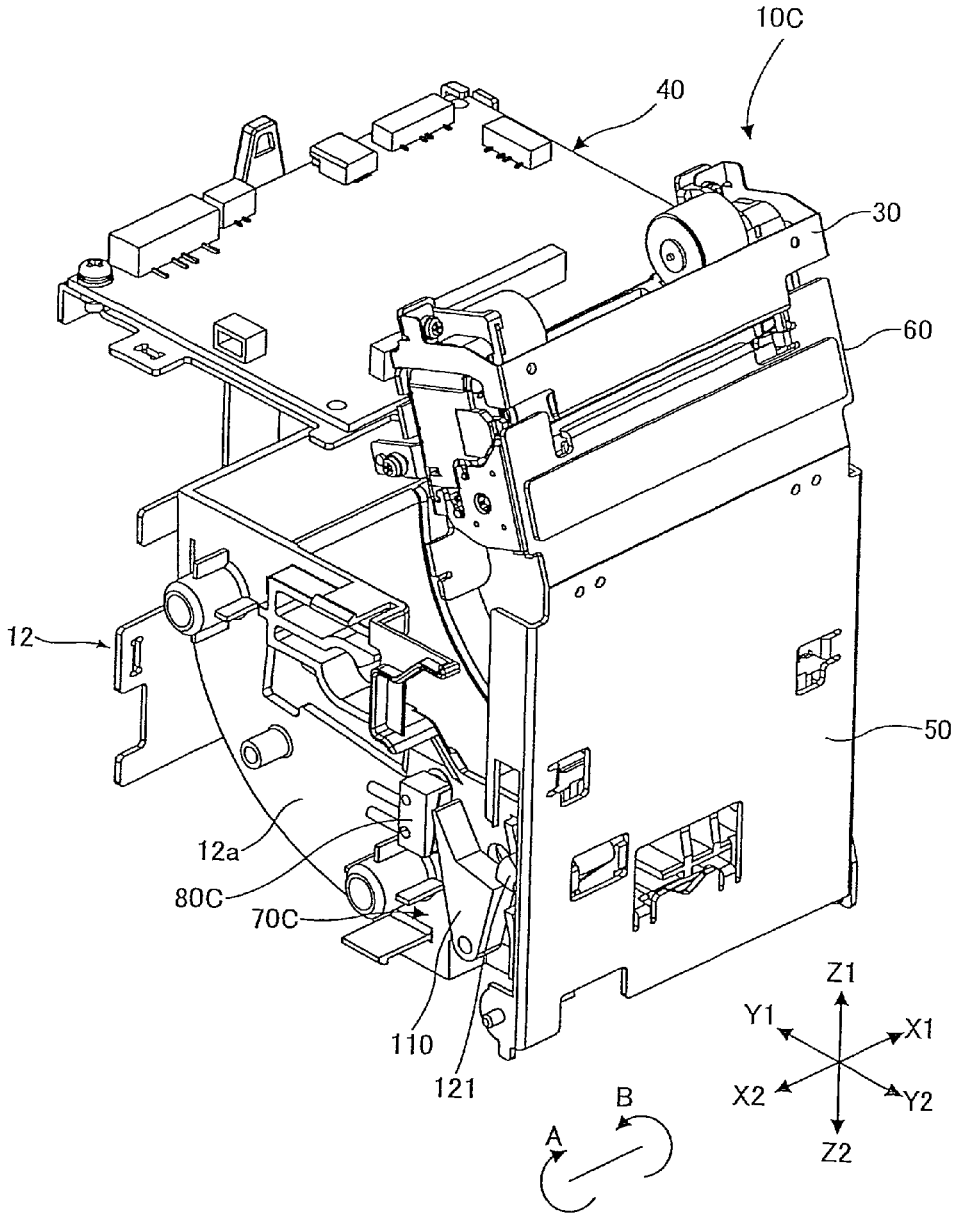
FIG. 16 is a perspective view of a thermal printer according to a fourth embodiment of the present invention.
Figure 17:
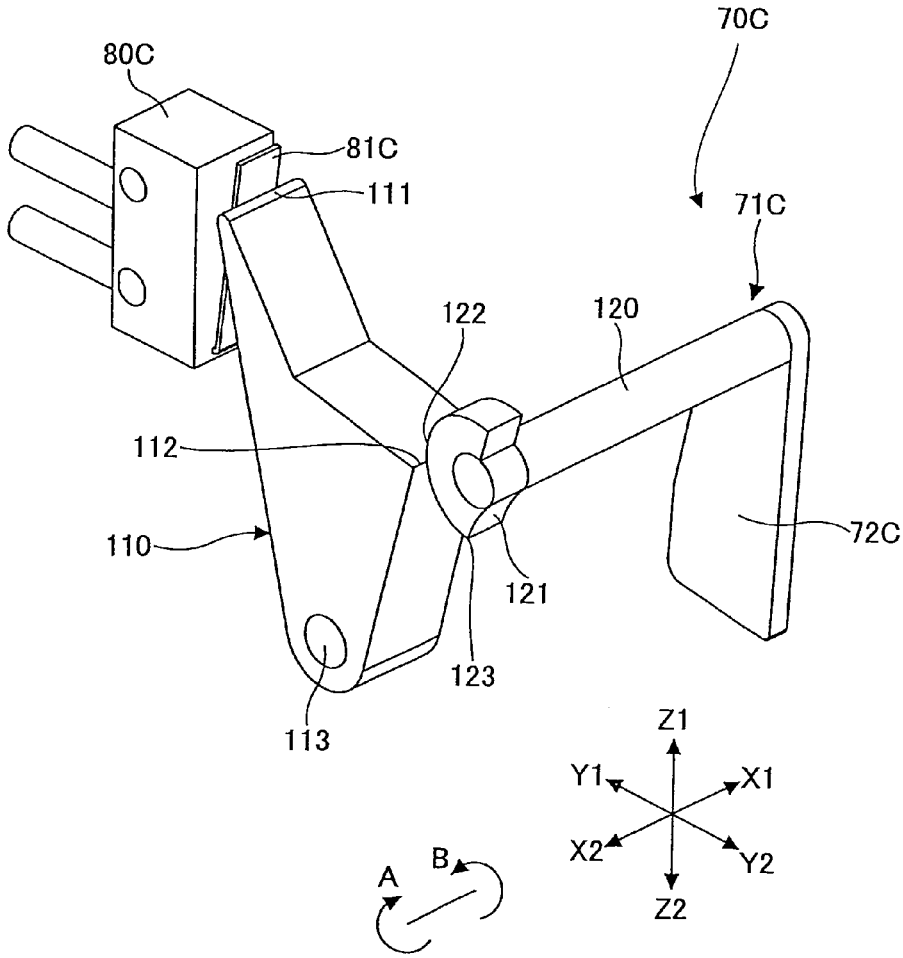
FIG. 17 is a perspective view of a near-end detecting mechanism shown in FIG. 16.
Figure 18:
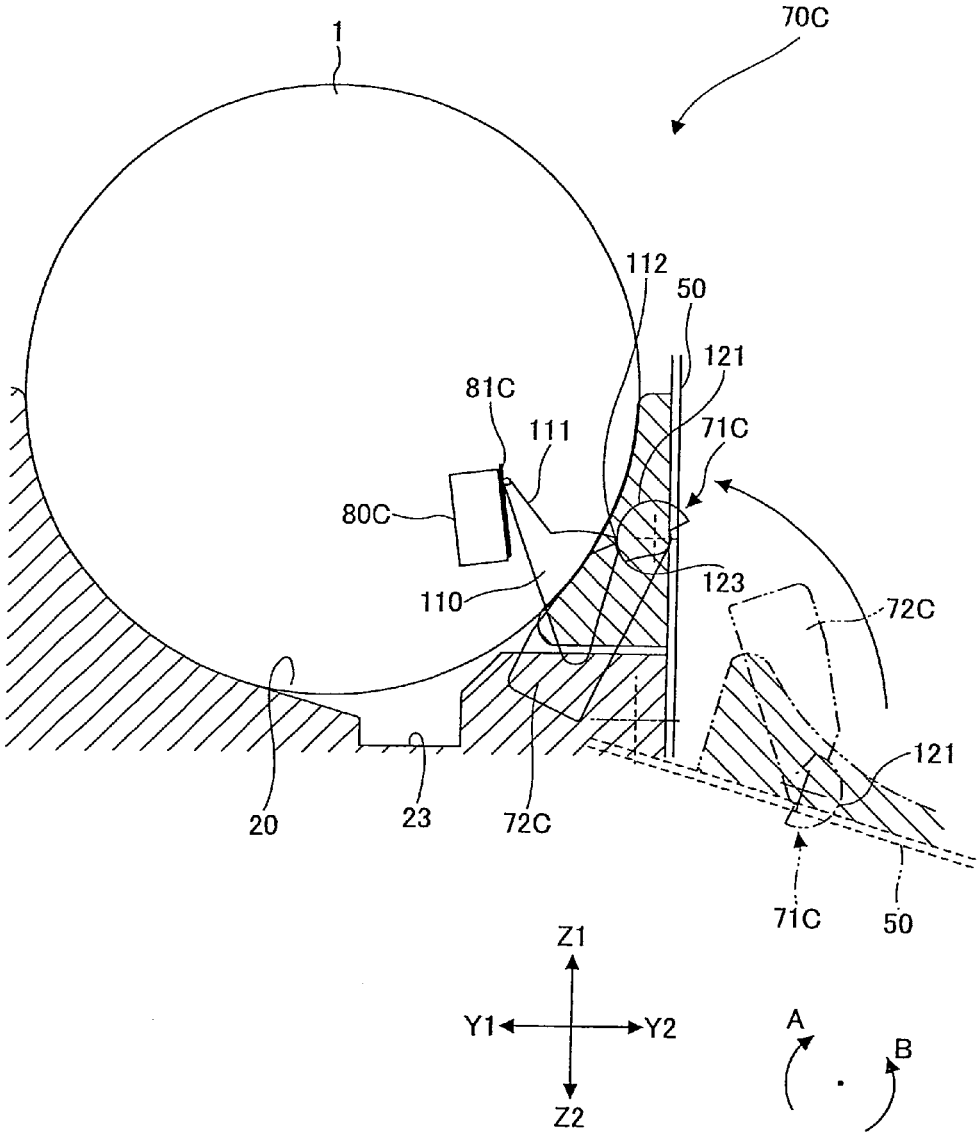
FIG. 18 is a cut-away side view of the near-end detecting mechanism shown in FIG. 16.

Referring to the drawings, a fourth embodiment of the present invention is described. FIG. 16 is a perspective view of a thermal printer 10C according to the fourth embodiment of the present invention. FIG. 17 is a perspective view of a near-end detecting mechanism 70C shown in FIG. 16. FIG. 18 is a cut-away side view of the near-end detecting mechanism 70C shown in FIG. 16. The structure of the thermal printer 10C is the same as that of the thermal printer 10 in the first embodiment of the present invention except for the near-end detecting mechanism 70C. In the fourth embodiment of the present invention, when a function of an element having a reference number is the same as that in the first embodiment of the present invention, the same reference number is used for the element.

As shown in FIG. 17, the near-end detecting mechanism 70C includes a detecting arm 71C, a detecting switch 80C, and an intermediate member 110.

The detecting arm 71 is attached to the lid 50, and the detecting switch 80C and the intermediate member 110 are attached to the main body 12.

The detecting arm 71C includes a shaft 120, an arm main body 72C at the X1 side of the shaft 120, and a cam 121 at the X2 side of the shaft 120. The arm main body 72C has an approximately triangle shape. The cam 121 has a cam surface 122 having an arc shape with the shaft 120 as the center and rotates with the arm main body 72C. In addition, the cam 121 includes an end part 123 of the cam surface 122.

Figure 19:
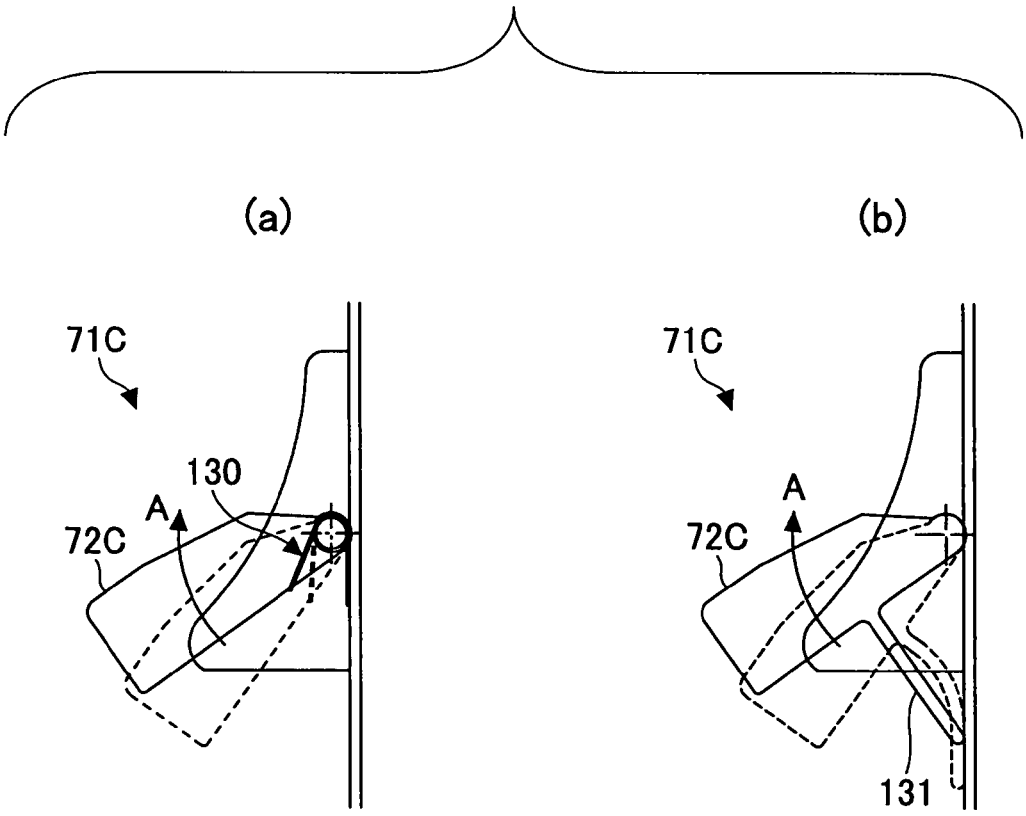
FIG. 19 is a cut-away side view of rotating mechanisms of a detecting arm of the near-end detecting mechanism shown in FIG. 16.
Figure 20:
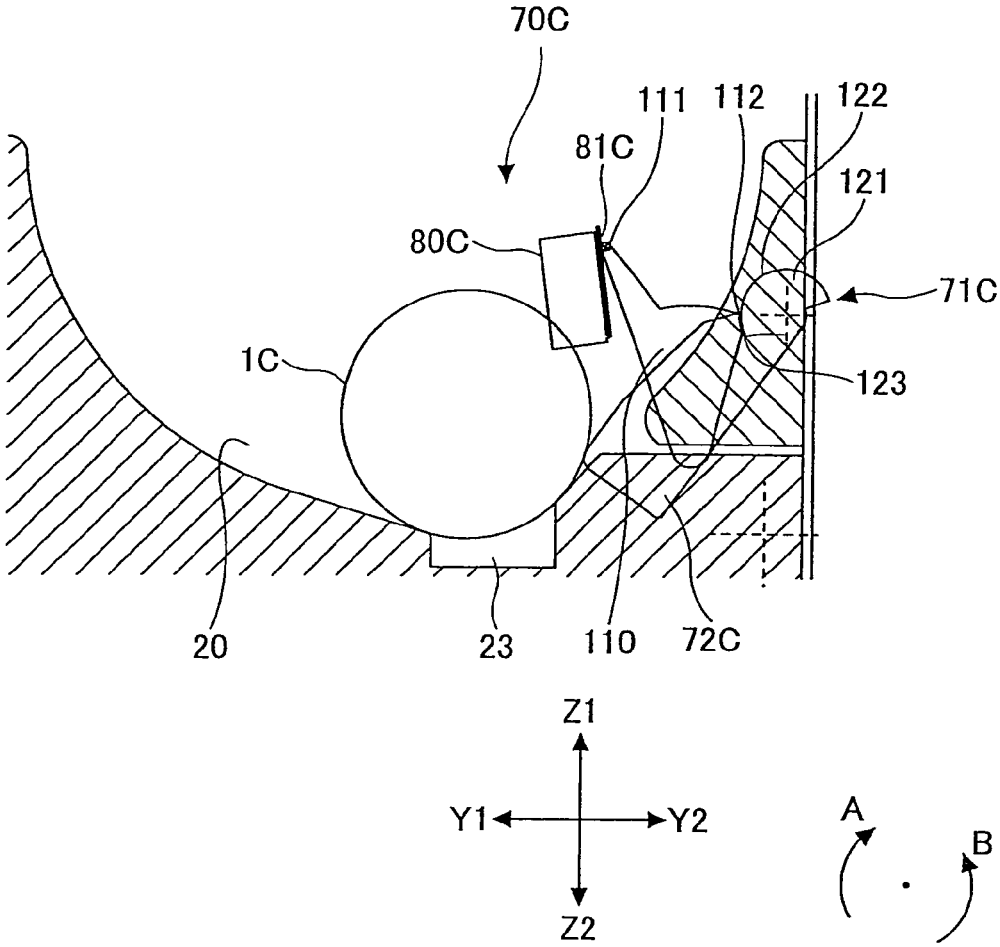
FIG. 20 is a cut-away side view of the near-end detecting mechanism shown in FIG. 16 close to the near-end state.

The detecting arm 71C is rotatably held at the rear side of the lid 50. As shown in FIG. 19(*a*), the detecting arm 71C is rotated in the arrow direction A by the spring force of a spring 130. In addition, as shown in FIG. 19(*b*), the detecting arm 71C can be rotated in the arrow direction A by the spring force of a spring 131 which extends from the arm main body 72C. As the detecting arm 71C, either one of those shown in FIGS. 19(*a*) and 19(*b*) can be used. When the lid 50 is closed, as shown in FIG. 20, the arm main body 72C protrudes into the paper roll container 20 and the cam 121 is positioned outside the front side plate 12*a* (refer to FIG. 16) of the main body 12. FIG. 19 is a cut-away side view of rotating mechanisms of the detecting arm 71C. In FIG. 19(*a*), the spring 130 is used, and in FIG. 19(*b*), the spring 131 is used.

As shown in FIGS. 16 and 20, the detecting switch 80C is screwed in the outer surface of the front side plate 12*a* of the main body 12 so that the movable plate 81C extends in the Z direction at the Y2 side of the detecting switch 80C.

As shown in FIG. 17, the intermediate member 110 has an approximately inverted triangle shape, and includes a stopper 111 at the Z1 and Y1 sides, and a corner part 112 at the Z1 and Y2 sides so that the intermediate member 110 is rotatably held in a predetermined angle by a shaft 113 at the Z2 side outside the front side plate 12*a* (refer to FIG. 16) of the main body 12.

The intermediate member 110 is disposed at the Y2 side of the detecting switch 80C and the stopper 111 faces the movable plate 81C. When the intermediate member 110 is rotated in the arrow direction A, the intermediate member 110 is apart from the detecting switch 80C, and the stopper 111 is apart from the movable plate 81C in a direction approximately perpendicular to the movable plate 81C.

When the lid 50 is closed, the intermediate member 110 is disposed at a position between the detecting switch 80C and the cam 121, and the cam 121 faces the corner part 112.

When a new paper roll 1 is loaded in the paper roll container 20 and the lid 50 is closed, the thermal printer 10C is as shown in FIG. 16, and the near-end detecting mechanism 70C is as shown in FIGS. 17 and 18.

As shown in FIG. 18, before the lid 50 is completely closed, the arm main body 72C contacts the outer circumferential surface of the new paper roll 1 in the paper roll container 20, the detecting arm 71C is slightly rotated in the arrow direction B, and the cam 121 faces the corner part 112. When the lid 50 is completely closed, the cam 121 pushes the corner part 112, the intermediate member 110 is locked, the stopper 111 pushes the movable plate 81C, the movable plate 81C is locked, and the detecting switch becomes ON.

While the diameter of the paper roll 1 becomes smaller by printing letters on the thermosensitive paper 2, the arm main body 72C is gradually rotated in the arrow direction A. The paper roll 1 gradually moves to the deepest position of the bottom in the paper roll container 20, and the paper roll 1 continues to rotate at the position of the groove 23. This is shown in FIG. 20. FIG. 20 is a cut-away side view of the near-end detecting mechanism 70C close to the near-end state.

Figure 21:
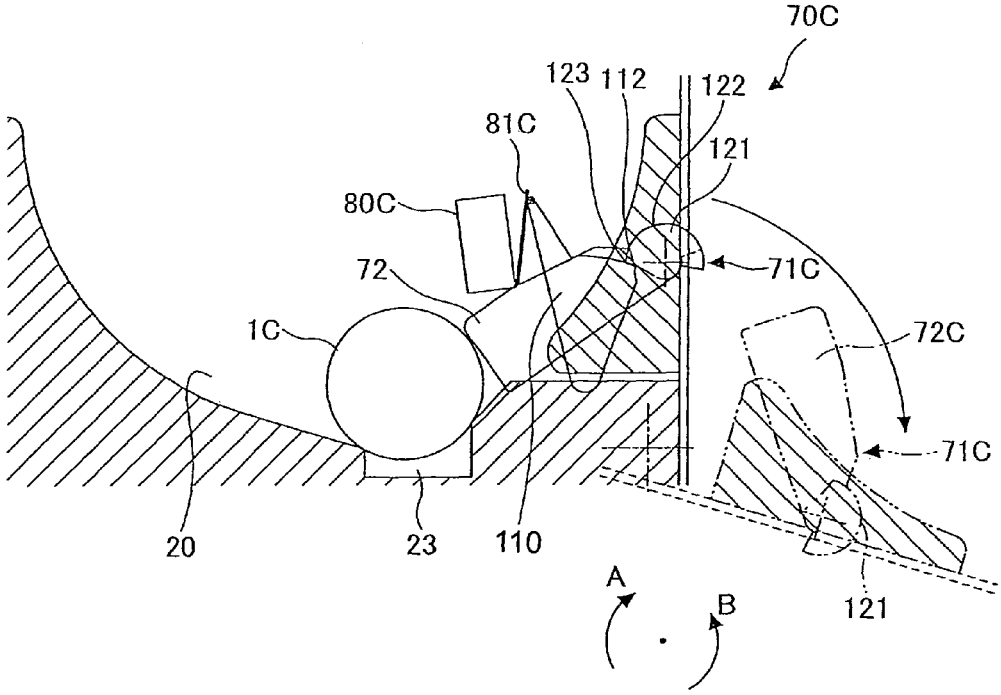
FIG. 21 is a cut-away side view of the near-end detecting mechanism shown in FIG. 16 in the near-end state of the paper roll.
Figure 22:
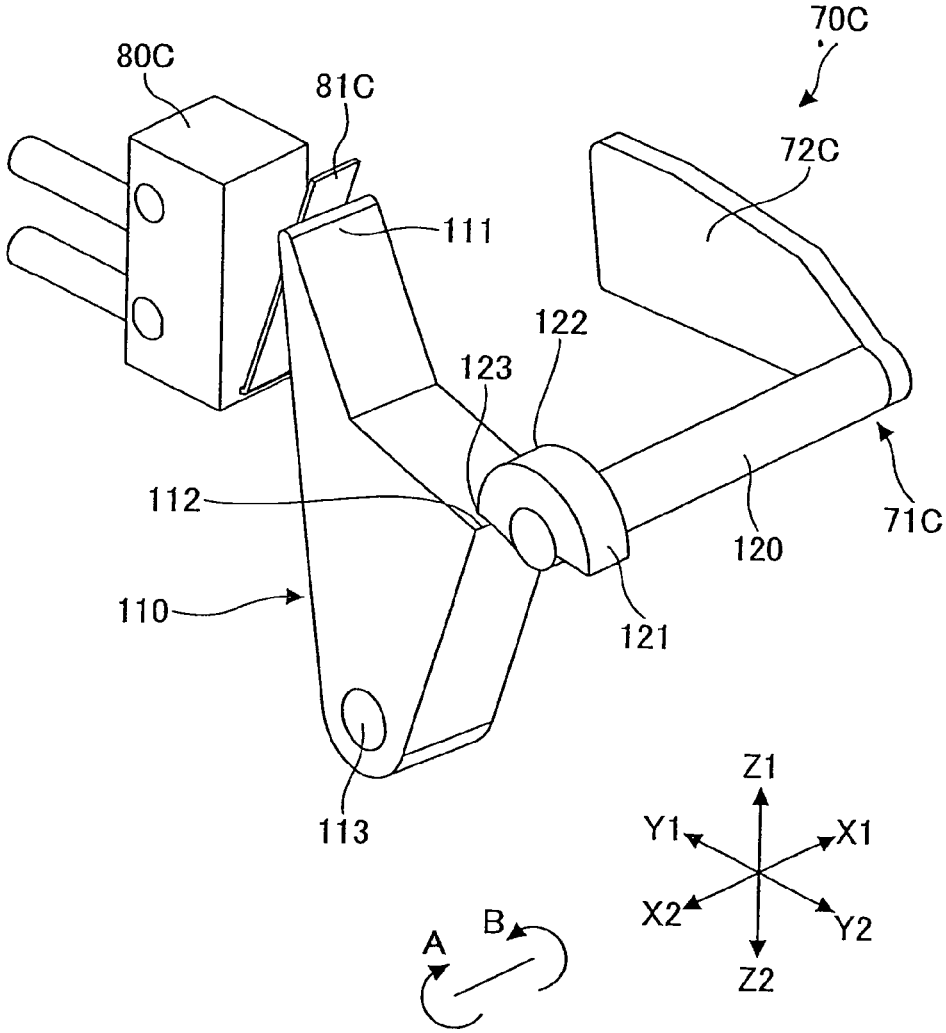
FIG. 22 is a perspective view of the near-end detecting mechanism shown in FIG. 16 in the near-end state of the paper roll.

FIG. 21 is a cut-away side view of the near-end detecting mechanism 70C in the near-end state. FIG. 22 is a perspective view of the near-end detecting mechanism 70C in the near-end state. When the paper roll 1 reaches the near-end state, as shown in FIGS. 21 and 22, the detecting arm 71C is rotated by a predetermined angle in the arrow direction A, the end part 123 of the cam 121 is separated from the corner part 112, and the intermediate member 110 is unlocked. The end of the movable plate 81C of the detecting switch 80C moves in the Y2 direction and rotates the intermediate member 110, and the detecting switch 81C becomes OFF.

Until the paper roll 1 reaches the near-end state, as shown in FIG. 20, the cam 121 continues to rotate and continues to stop the corner part 112. That is, the cam 121 continues to lock the intermediate member 110, and the detecting switch 80C maintains ON.

Figure 23:
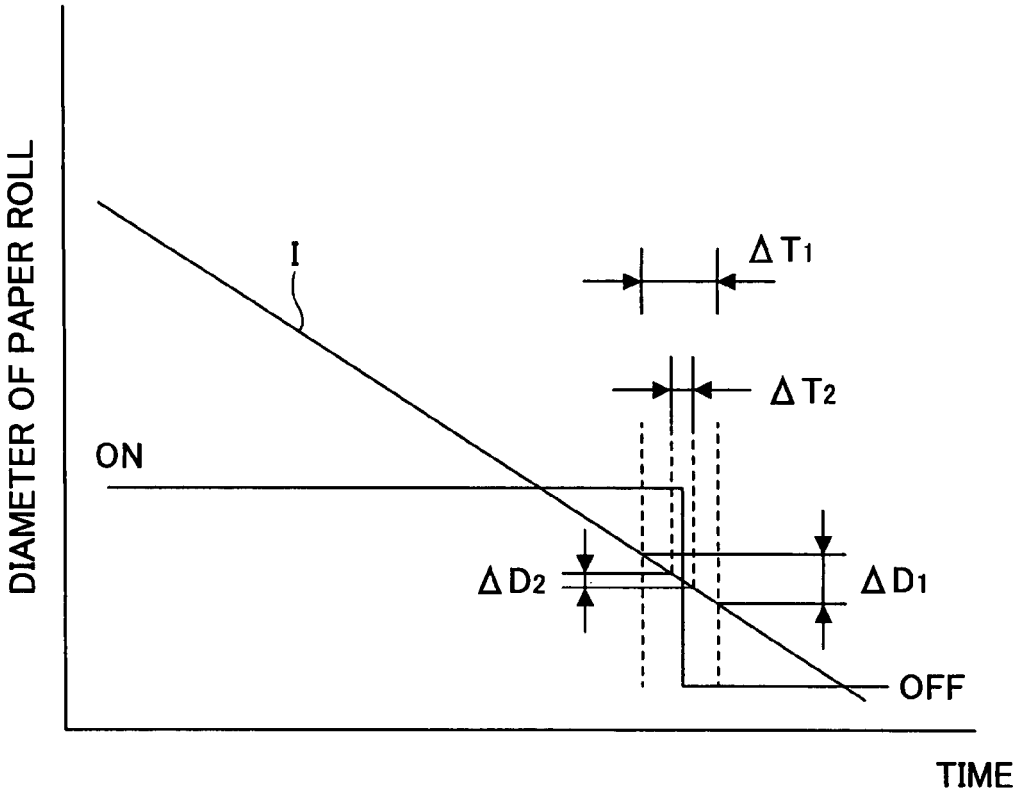
FIG. 23 is a graph showing characteristics of the near-end detecting mechanism shown in FIG. 16.

FIG. 23 is a graph showing characteristics of the near-end detecting mechanism 70C. In more detail, in plural thermal printers 10C, in FIG. 23, dispersion of the diameters of the paper rolls 1 in the corresponding thermal printers 10C is shown when the detecting switch 80C of each thermal printer 10C becomes OFF in a case where printing letters on the thermosensitive paper 2 is continued and the diameter of the paper roll 1 becomes small with the passage of time. The line "I" shows the diameter of the paper roll 1. In addition, in FIG. 23, characteristic of conventional thermal printers are shown.

In FIG. 23, generally, in each of the conventional plural thermal printers, when a paper roll approaches the near-end state and a detecting switch is switched to OFF, the switched off time has dispersion "$\Delta T_1$" caused by the characteristics of the conventional plural thermal printers. Consequently, when the near-end states are detected by the corresponding conventional plural thermal printers, the diameters of the paper rolls in the conventional plural thermal printers have dispersion "$\Delta D_1$".

However, in the fourth embodiment of the present invention, in each of the plural thermal printers 10C, when the paper roll 1 approaches the near-end state, the movable plate 81C of the detecting switch 80C is gradually moved by the rotation of the detecting arm 71C, and the detecting switch 80C is switched to OFF; since the detecting switch 80C is switched to OFF when the intermediate member 110 is unlocked, the time dispersion in the plural thermal printers 10C becomes "$\Delta T_2$" when the detecting switches 80C are switched to OFF. Consequently, when the near-end states are detected by the plural thermal printers 10C, the diameters of the paper rolls 1 in the plural thermal printers 10C have dispersion "$\Delta D_2$" which is smaller than the dispersion "$\Delta D_1$".

Therefore, since the dispersion of the diameters of the paper rolls 1 in the near-end state is small, it is not required to adjust the attaching potion of the detecting switch 80*c* to the near-end detecting mechanism 70C.

When a new paper roll 1 is loaded in the paper roll container 20 and the lid 50 is closed, as shown in FIG. 18, the cam 121 pushes the corner part 112 of the intermediate member 110, and the stopper 111 of the intermediate member 110 pushes the movable plate 81C. With this, the detecting switch 80C becomes ON. Since the intermediate member 110 is disposed, when the lid 50 is closed, the near-end detecting mechanism 70C becomes stable.

As the intermediate member 110, instead of rotatably moving, an intermediate member capable of moving linearly can be used. That is, when the intermediate member can be attached to the front side plate 12*a* of the main body 12, any movement can be acceptable.

Fifth Embodiment

Figure 24A:
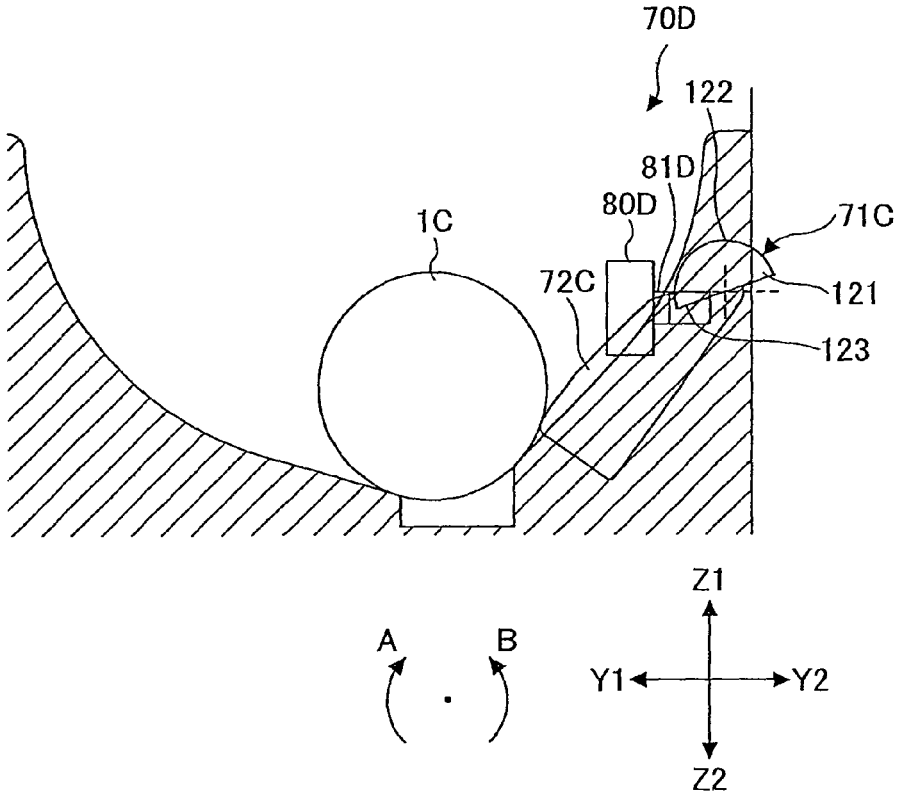
FIG. 24A is a cut-away side view of a near-end detecting mechanism according to a fifth embodiment of the present invention close to the near-end state of the paper roll.
Figure 24B:
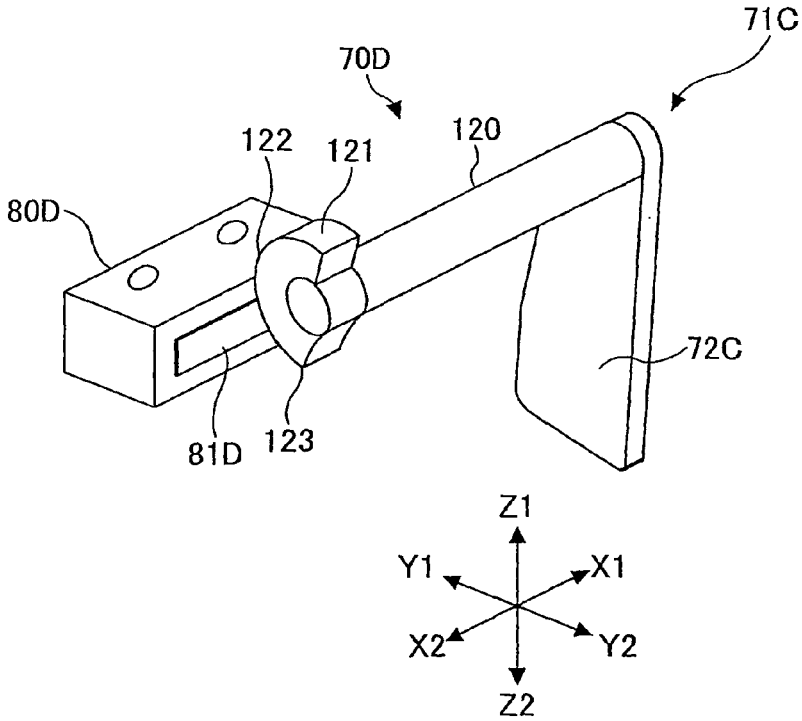
FIG. 24B is a perspective view of the near-end detecting mechanism shown in FIG. 24A.
Figure 25A:
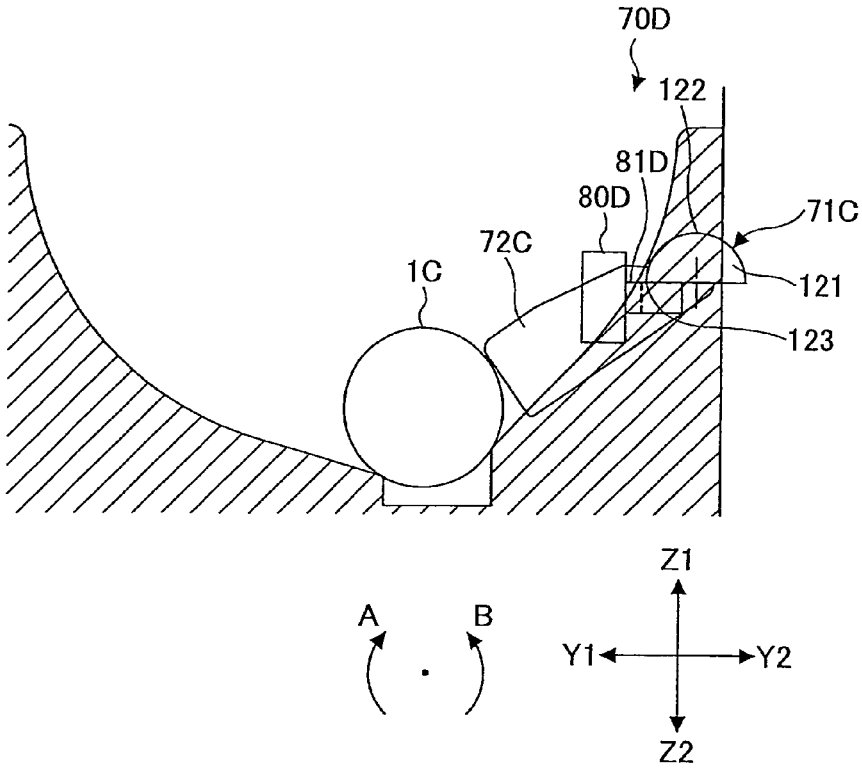
FIG. 25A is a cut-away side view of the near-end detecting mechanism shown in FIG. 24A in the near-end state of the paper roll.
Figure 25B:
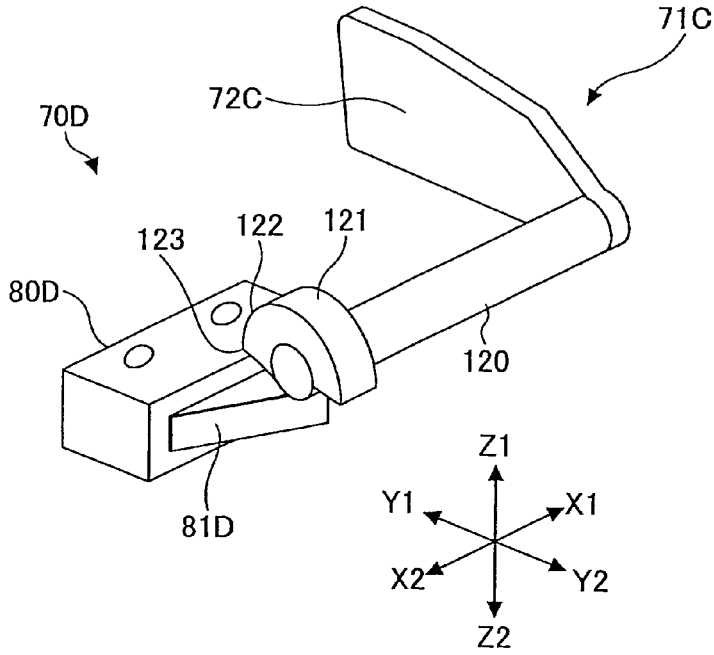
FIG. 25B is a perspective view of the near-end detecting mechanism shown in FIG. 25A.

Referring to the drawings, a fifth embodiment of the present invention is described. In the fifth embodiment of the present invention, when a function of an element having a reference number is the same as that in the fourth embodiment of the present invention, the same reference number is used for the element. FIG. 24A is a cut-away side view of a near-end detecting mechanism 70D according to the fifth embodiment of the present invention close to the near-end state of the paper roll 1. FIG. 24B is a perspective view of the near-end detecting mechanism 70D shown in FIG. 24A. FIG. 25A is a cut-away side view of the near-end detecting mechanism 70D shown in FIG. 24A in the near-end state of the paper roll 1. FIG. 25B is a perspective view of the near-end detecting mechanism 70D shown in FIG. 25A.

In the near-end detecting mechanism 70D, the cam 121 of the detecting arm 71C directly pushes a movable plate 81D of a detecting switch 80D.

In FIGS. 24A and 24B, since the paper roll 1 is close to the near-end state, the cam 121 stops the movement of the movable plate 81D of the detecting switch 80D, and the detecting switch 80D is ON.

The detecting switch 80D is approximately horizontally attached to the front side plate 12*a* of the main body 12 (refer to FIG. 16), the length direction of the movable plate 81D is the X direction and the width direction of the movable plate 81D is the Y direction, and the movable plate 81D is at the Y2 side of the detecting switch 80D. When the cam 121 is rotated while the paper roll 1 is used, the cam surface 122 continues to push the movable plate 81D.

When the paper roll 1 reaches the near-end state and the detecting arm 71C is rotated by a predetermined angle, as shown in FIGS. 25A and 25B, the end part 123 of the cam surface 122 of the cam 121 is separated from the X1 side end of the movable plate 81D of the detecting switch 80D, the lock of the movable plate 81D is released, and the detecting switch 80D becomes OFF.

Even when the paper roll 1 is close to the near-end state, the movable plate 81D continues to be locked by the cam 121, and the detecting switch 80D does not become OFF. When the paper roll 1 reaches the near-end state, the detecting switch 80D becomes OFF.

In the embodiments of the present invention, as the detecting switch 80 (including 80A through 80D), a mechanical switch is used; however, the detecting switch 80 (including 80A through 80D) is not limited to the mechanical switch, and can be an optical switch, for example, a photointerrupter.

As described above, the near-end detecting mechanism 70 (including 70A through 70D) in the embodiments of the present invention can be applied to any printer in addition to the thermal printer 10 (including 10A through 10C).

Further, the present invention is not limited to these embodiments, but variations and modifications may be made without departing from the scope of the present invention.

The present application is based on Japanese Priority Patent Application No. 2006-285715 filed on Oct. 20, 2006, and Japanese Priority Patent Application No. 2007-231778 filed on Sep. 6, 2007, with the Japanese Patent Office, the entire contents of which are hereby incorporated herein by reference.

What is claimed is:

1. A printer, comprising:

a main body having a paper roll container for containing a paper roll in which belt-shaped paper is wound plenty of times;

a lid rotatably attached to the main body for closing an opening section of the main body through which opening section the paper roll is loaded in the paper roll container;

a letter printing mechanism which operates when the lid is closed and prints a letter (image) on the belt-shaped paper of the paper roll by pulling out the belt-shaped paper from the paper roll container; and a detecting arm which detects a near-end state of the paper roll contained in the paper roll container;

wherein the detecting arm is rotatably attached onto a rear surface of the lid, when the lid is closed, the lid is disposed at an approximately vertical position, an upper part of the detecting arm is held by the rear surface of the lid as a rotational center, the detecting arm is rotated so that the detecting arm protrudes into the paper roll container, the rotation of the detecting arm is stopped when the detecting arm contacts an outer circumferential surface of the paper roll contained in the paper roll container, and when the paper roll reaches the near-end state, the detecting arm is not stopped by the outer circumferential surface of the paper roll and rotates by a predetermined angle.

2. The printer as claimed in claim 1, wherein:

the lid includes an auxiliary holder member, which faces the paper roll contained in the paper roll container when the lid is closed, mounted on the rear surface of the lid; and shafts of the detecting arm are held by the auxiliary holder member.

3. The printer as claimed in claim 1, further comprising:

a detecting switch attached to the main body by which detecting switch the detecting arm detects the near-end state of the paper roll.

4. The printer as claimed in claim 1, further comprising:

a detecting switch attached to the lid by which detecting switch the detecting arm detects the near-end state of the paper roll.

5. The printer as claimed in claim 1, further comprising:

a controlling mechanism which controls positioning the detecting arm at a position where the detecting arm does not obstruct loading the paper roll in the paper roll container when the lid is opened and releases the control when the lid is closed.

6. The printer as claimed in claim 5, wherein:

the controlling mechanism includes a controlling section attached to the main body, and a protrusion protruding from the detecting arm, which protrusion contacts the inside surface of the controlling section.

7. The printer as claimed in claim 1, further comprising:

a groove in the paper roll container for positioning the paper roll whose diameter becomes small at a position near the detecting arm so that the paper roll whose diameter becomes small is suitably positioned in the paper roll container.

8. The printer as claimed in claim 1, wherein:

the detecting arm includes an arm main body which contacts the outer circumferential surface of the paper roll contained in the paper roll container when the lid is closed; and a cam which moves together with the arm main body;

the arm main body is gradually rotated while the paper roll is being used, and is immediately rotated by a predetermined angle when the paper roll reaches the near-end state by not contacting the outer circumferential surface of the paper roll; and the main body includes a switch having a movable plate; and until the arm main body is rotated by the predetermined angle, the cam stops the movement of the movable plate by contacting the movable plate; and when the arm main body is rotated by the predetermined angle, the cam releases the stopping of the movement of the movable plate and the switch becomes OFF.

9. The printer as claimed in claim 1, wherein:

the detecting arm includes an arm main body which contacts the outer circumferential surface of the paper roll contained in the paper roll container when the lid is closed; and a cam which moves together with the arm main body;

the arm main body is gradually rotated while the paper roll is being used, and is immediately rotated by a predetermined angle when the paper roll reaches the near-end state by not contacting the outer circumferential surface of the paper roll; and the main body includes a switch having a movable plate;

an intermediate member whose one end contacts the movable plate and whose other end contacts the cam when the lid is closed; and until the arm main body is rotated by the predetermined angle, the cam stops the movement of the intermediate member by contacting the intermediate member, and the intermediate member stops the movement of the movable plate; and when the arm main body is rotated by the predetermined angle, the cam releases the stopping of the movement of the intermediate member and the intermediate member releases the stopping of the movable plate and the switch becomes OFF.

10. The printer as claimed in claim 9, wherein:

the intermediate member moves in a direction perpendicular to the movable plate of the switch when the intermediate member is separated from the movable plate of the switch.

* * * * *